US011342175B2

(12) United States Patent
Brown et al.

(10) Patent No.: US 11,342,175 B2
(45) Date of Patent: May 24, 2022

(54) MULTI-REFLECTING TIME OF FLIGHT MASS ANALYSER

(71) Applicant: Micromass UK Limited, Wilmslow (GB)

(72) Inventors: Jeffery Mark Brown, Hyde (GB); Boris Kozlov, Manchester (GB)

(73) Assignee: Micromass UK Limited, Wilmslow (GB)

( * ) Notice: Subject to any disclaimer, the term of this patent is extended or adjusted under 35 U.S.C. 154(b) by 0 days.

(21) Appl. No.: 17/054,351

(22) PCT Filed: May 3, 2019

(86) PCT No.: PCT/GB2019/051234
§ 371 (c)(1),
(2) Date: Nov. 10, 2020

(87) PCT Pub. No.: WO2019/215428
PCT Pub. Date: Nov. 14, 2019

(65) Prior Publication Data

US 2021/0193451 A1 Jun. 24, 2021

(30) Foreign Application Priority Data

May 10, 2018 (GB) ..... 1807605

(51) Int. Cl.
*H01J 49/40* (2006.01)
*H01J 49/02* (2006.01)
*H01J 49/06* (2006.01)

(52) U.S. Cl.
CPC ..... *H01J 49/406* (2013.01); *H01J 49/025* (2013.01); *H01J 49/061* (2013.01); *H01J 49/401* (2013.01)

(58) Field of Classification Search
CPC ..... H01J 49/025; H01J 49/061; H01J 49/40; H01J 49/401; H01J 49/406
See application file for complete search history.

(56) References Cited

U.S. PATENT DOCUMENTS 3,898,452 A 8/1975 Hertel
4,390,784 A 6/1983 Browning et al.
(Continued)

FOREIGN PATENT DOCUMENTS

CA 2412657 C 5/2003
CN 101369510 A 2/2009
(Continued)

OTHER PUBLICATIONS

"Collision Frequency", https://en.wikipedia.org/wiki/Collision_frequency, accessed Aug. 17, 2021 (Year: 2021).*
(Continued)

*Primary Examiner* — David E Smith

(57) ABSTRACT

A mass spectrometer comprising: a multi-reflecting time of flight (MRTOF) mass analyser or mass separator having two gridless ion mirrors 2 that are elongated in a first dimension (Z-dimension) and configured to reflect ions multiple times in a second orthogonal dimension (X-dimension) as the ions travel in the first dimension; the spectrometer configured to operate in: (i) a first mode for ions having a first rate of interaction with background gas molecules in the mass analyser or separator, such that the ions are reflected a first number of times between the ion mirrors 2; and (ii) a second mode for ions having a second, higher rate of interaction with background gas molecules in the mass analyser or separator, such that ions are reflected a second, lower number of times between the ion mirrors 2.

19 Claims, 2 Drawing Sheets

(56) References Cited

U.S. PATENT DOCUMENTS 4,691,160 A 9/1987 Ino
4,731,532 A 3/1988 Frey et al.
4,855,595 A 8/1989 Blanchard
5,017,780 A 5/1991 Kutscher et al.
5,107,109 A 4/1992 Stafford, Jr. et al.
5,128,543 A 7/1992 Reed et al.
5,202,563 A 4/1993 Cotter et al.
5,331,158 A 7/1994 Dowell
5,367,162 A 11/1994 Holland et al.
5,396,065 A 3/1995 Myerholtz et al.
5,435,309 A 7/1995 Thomas et al.
5,464,985 A 11/1995 Cornish et al.
5,619,034 A 4/1997 Reed et al.
5,654,544 A 8/1997 Dresch
5,689,111 A 11/1997 Dresch et al.
5,696,375 A 12/1997 Park et al.
5,719,392 A 2/1998 Franzen
5,763,878 A 6/1998 Franzen
5,777,326 A 7/1998 Rockwood et al.
5,834,771 A 11/1998 Yoon et al.
5,847,385 A 12/1998 Dresch
5,869,829 A 2/1999 Dresch
5,955,730 A 9/1999 Kerley et al.
5,994,695 A 11/1999 Young
6,002,122 A 12/1999 Wolf
6,013,913 A 1/2000 Hanson
6,020,586 A 2/2000 Dresch et al.
6,080,985 A 6/2000 Welkie et al.
6,107,625 A 8/2000 Park
6,160,256 A 12/2000 Ishihara
6,198,096 B1 3/2001 Le Cocq
6,229,142 B1 5/2001 Bateman et al.
6,271,917 B1 8/2001 Hagler
6,300,626 B1 10/2001 Brock et al.
6,316,768 B1 11/2001 Rockwood et al.
6,337,482 B1 1/2002 Francke
6,384,410 B1 5/2002 Kawato
6,393,367 B1 5/2002 Tang et al.
6,437,325 B1 8/2002 Reilly et al.
6,455,845 B1 9/2002 Li et al.
6,469,295 B1 10/2002 Park
6,489,610 B1 12/2002 Barofsky et al.
6,504,148 B1 1/2003 Hager
6,504,150 B1 1/2003 Verentchikov et al.
6,534,764 B1 3/2003 Verentchikov et al.
6,545,268 B1 4/2003 Verentchikov et al.
6,570,152 B1 5/2003 Hoyes
6,576,895 B1 6/2003 Park
6,580,070 B2 6/2003 Cornish et al.
6,591,121 B1 7/2003 Madarasz et al.
6,614,020 B2 9/2003 Cornish
6,627,877 B1 9/2003 Davis et al.
6,646,252 B1 11/2003 Gonin
6,647,347 B1 11/2003 Roushall et al.
6,664,545 B2 12/2003 Kimmel et al.
6,683,299 B2 1/2004 Fuhrer et al.
6,694,284 B1 2/2004 Nikoonahad et al.
6,717,132 B2 4/2004 Franzen
6,734,968 B1 5/2004 Wang et al.
6,737,642 B2 5/2004 Syage et al.
6,744,040 B2 6/2004 Park
6,744,042 B2 6/2004 Zajfman et al.
6,747,271 B2 6/2004 Gonin et al.
6,770,870 B2 8/2004 Vestal
6,782,342 B2 8/2004 LeGore et al.
6,787,760 B2 9/2004 Belov et al.
6,794,643 B2 9/2004 Russ, IV et al.
6,804,003 B1 10/2004 Wang et al.
6,815,673 B2 11/2004 Plomley et al.
6,833,544 B1 12/2004 Campbell et al.
6,836,742 B2 12/2004 Brekenfeld
6,841,936 B2 1/2005 Keller et al.
6,861,645 B2 3/2005 Franzen
6,864,479 B1 3/2005 Davis et al.
6,870,156 B2 3/2005 Rather
6,870,157 B1 3/2005 Zare
6,872,938 B2 3/2005 Makarov et al.
6,888,130 B1 5/2005 Gonin
6,900,431 B2 5/2005 Belov et al.
6,906,320 B2 6/2005 Sachs et al.
6,940,066 B2 9/2005 Makarov et al.
6,949,736 B2 9/2005 Ishihara
7,034,292 B1 4/2006 Whitehouse et al.
7,071,464 B2 7/2006 Reinhold
7,084,393 B2 8/2006 Fuhrer et al.
7,091,479 B2 8/2006 Hayek
7,126,114 B2 10/2006 Chernushevich
7,196,324 B2 3/2007 Verentchikov
7,217,919 B2 5/2007 Boyle et al.
7,221,251 B2 5/2007 Menegoli et al.
7,326,925 B2 2/2008 Verentchikov et al.
7,351,958 B2 4/2008 Vestal
7,365,313 B2 4/2008 Fuhrer et al.
7,385,187 B2 6/2008 Verentchikov et al.
7,388,197 B2 6/2008 McLean et al.
7,399,957 B2 7/2008 Parker et al.
7,423,259 B2 9/2008 Hidalgo et al.
7,498,569 B2 3/2009 Ding
7,501,621 B2 3/2009 Willis et al.
7,504,620 B2 3/2009 Sato et al.
7,521,671 B2 4/2009 Kirihara et al.
7,541,576 B2 6/2009 Belov et al.
7,582,864 B2 9/2009 Verentchikov
7,608,817 B2 10/2009 Flory
7,663,100 B2 2/2010 Vestal
7,675,031 B2 3/2010 Konicek et al.
7,709,789 B2 5/2010 Vestal et al.
7,728,289 B2 6/2010 Naya et al.
7,745,780 B2 6/2010 McLean et al.
7,755,036 B2 7/2010 Satoh
7,772,547 B2 8/2010 Verentchikov
7,800,054 B2 9/2010 Fuhrer et al.
7,825,373 B2 11/2010 Willis et al.
7,863,557 B2 1/2011 Brown
7,884,319 B2 2/2011 Willis et al.
7,932,491 B2 4/2011 Vestal
7,982,184 B2 7/2011 Sudakov
7,985,950 B2 7/2011 Makarov et al.
7,989,759 B2 8/2011 Holle
7,999,223 B2 8/2011 Makarov et al.
8,017,907 B2 9/2011 Willis et al.
8,017,909 B2 9/2011 Makarov et al.
8,063,360 B2 11/2011 Willis et al.
8,080,782 B2 12/2011 Hidalgo et al.
8,093,554 B2 1/2012 Makarov
8,237,111 B2 8/2012 Golikov et al.
8,354,634 B2 1/2013 Green et al.
8,373,120 B2 2/2013 Verentchikov
8,395,115 B2 3/2013 Makarov et al.
8,492,710 B2 7/2013 Fuhrer et al.
8,513,594 B2 8/2013 Makarov
8,633,436 B2 1/2014 Ugarov
8,637,815 B2 1/2014 Makarov et al.
8,642,948 B2 2/2014 Makarov et al.
8,642,951 B2 2/2014 Li
8,648,294 B2 2/2014 Prather et al.
8,653,446 B1 2/2014 Mordehai et al.
8,658,984 B2 2/2014 Makarov et al.
8,680,481 B2 3/2014 Giannakopulos et al.
8,723,108 B1 5/2014 Ugarov
8,735,818 B2 5/2014 Kovtoun et al.
8,772,708 B2 7/2014 Kinugawa et al.
8,785,845 B2 7/2014 Loboda
8,847,155 B2 9/2014 Vestal
8,853,623 B2 10/2014 Verenchikov
8,884,220 B2 11/2014 Hoyes et al.
8,921,772 B2 12/2014 Verenchikov
8,952,325 B2 2/2015 Giles et al.
8,957,369 B2 2/2015 Makarov
8,975,592 B2 3/2015 Kobayashi et al.
9,048,080 B2 6/2015 Verenchikov et al.
9,082,597 B2 7/2015 Willis et al.
9,082,604 B2 7/2015 Verenchikov
9,099,287 B2 8/2015 Giannakopulos

(56) References Cited

U.S. PATENT DOCUMENTS 9,136,101 B2* 9/2015 Grinfeld ..... H01J 49/0027
9,147,563 B2 9/2015 Makarov
9,196,469 B2 11/2015 Makarov
9,207,206 B2 12/2015 Makarov
9,214,322 B2 12/2015 Kholomeev et al.
9,214,328 B2 12/2015 Hoyes et al.
9,281,175 B2 3/2016 Haufler et al.
9,312,119 B2 4/2016 Verenchikov
9,324,544 B2 4/2016 Rather
9,373,490 B1 6/2016 Nishiguchi et al.
9,396,922 B2 7/2016 Verenchikov et al.
9,417,211 B2 8/2016 Verenchikov
9,425,034 B2 8/2016 Verentchikov et al.
9,472,390 B2 10/2016 Verenchikov et al.
9,514,922 B2 12/2016 Watanabe et al.
9,576,778 B2 2/2017 Wang
9,595,431 B2 3/2017 Verenchikov
9,673,033 B2 6/2017 Grinfeld et al.
9,679,758 B2 6/2017 Grinfeld et al.
9,683,963 B2 6/2017 Verenchikov
9,728,384 B2 8/2017 Verenchikov
9,779,923 B2 10/2017 Verenchikov
9,786,484 B2 10/2017 Willis et al.
9,786,485 B2 10/2017 Ding et al.
9,865,441 B2 1/2018 Damoc et al.
9,865,445 B2 1/2018 Verenchikov et al.
9,870,903 B2 1/2018 Richardson et al.
9,870,906 B1 1/2018 Quarmby et al.
9,881,780 B2 1/2018 Verenchikov et al.
9,899,201 B1 2/2018 Park
9,922,812 B2 3/2018 Makarov
9,941,107 B2 4/2018 Verenchikov
9,972,483 B2 5/2018 Makarov
10,006,892 B2 6/2018 Verenchikov
10,037,873 B2 7/2018 Wang et al.
10,141,175 B2 11/2018 Verentchikov et al.
10,141,176 B2 11/2018 Stewart et al.
10,163,616 B2 12/2018 Verenchikov et al.
10,186,411 B2 1/2019 Makarov
10,192,723 B2 1/2019 Verenchikov et al.
10,290,480 B2 5/2019 Crowell et al.
10,373,815 B2 8/2019 Crowell et al.
10,388,503 B2 8/2019 Brown et al.
10,593,525 B2 3/2020 Hock et al.
10,593,533 B2 3/2020 Hoyes et al.
10,622,203 B2 4/2020 Veryovkin et al.
10,629,425 B2 4/2020 Hoyes et al.
10,636,646 B2 4/2020 Hoyes et al.
2001/0011703 A1 8/2001 Franzen
2001/0030284 A1 10/2001 Dresch et al.
2002/0030159 A1 3/2002 Chernushevich et al.
2002/0107660 A1 8/2002 Nikoonahad et al.
2002/0190199 A1 12/2002 Li
2003/0010907 A1 1/2003 Hayek et al.
2003/0111597 A1 6/2003 Gonin et al.
2003/0232445 A1 12/2003 Fulghum
2004/0026613 A1* 2/2004 Bateman ..... H01J 49/062
250/281
2004/0084613 A1 5/2004 Bateman et al.
2004/0108453 A1 6/2004 Kobayashi et al.
2004/0119012 A1 6/2004 Vestal
2004/0144918 A1 7/2004 Zare et al.
2004/0155187 A1 8/2004 Axelsson
2004/0159782 A1 8/2004 Park
2004/0183007 A1 9/2004 Belov et al.
2005/0006577 A1 1/2005 Fuhrer et al.
2005/0040326 A1 2/2005 Enke
2005/0103992 A1 5/2005 Yamaguchi et al.
2005/0133712 A1 6/2005 Belov et al.
2005/0151075 A1 7/2005 Brown et al.
2005/0194528 A1 9/2005 Yamaguchi et al.
2005/0242279 A1 11/2005 Verentchikov
2005/0258364 A1 11/2005 Whitehouse et al.
2006/0024720 A1 2/2006 McLean et al.
2006/0169882 A1 8/2006 Pau et al.
2006/0214100 A1 9/2006 Verentchikov et al.
2006/0289746 A1 12/2006 Raznikov et al.
2007/0023645 A1 2/2007 Chernushevich
2007/0029473 A1 2/2007 Verentchikov
2007/0176090 A1 8/2007 Verentchikov
2007/0187614 A1 8/2007 Schneider et al.
2007/0194223 A1 8/2007 Sato et al.
2008/0049402 A1 2/2008 Han et al.
2008/0197276 A1 8/2008 Nishiguchi et al.
2008/0203288 A1 8/2008 Makarov et al.
2008/0290269 A1 11/2008 Saito et al.
2009/0090861 A1 4/2009 Willis et al.
2009/0114808 A1 5/2009 Bateman et al.
2009/0121130 A1 5/2009 Satoh
2009/0206250 A1 8/2009 Wollnik
2009/0250607 A1 10/2009 Staats et al.
2009/0272890 A1 11/2009 Ogawa et al.
2009/0294658 A1 12/2009 Vestal et al.
2009/0314934 A1 12/2009 Brown
2010/0001180 A1 1/2010 Bateman et al.
2010/0044558 A1 2/2010 Sudakov
2010/0072363 A1 3/2010 Giles et al.
2010/0078551 A1 4/2010 Loboda
2010/0096543 A1 4/2010 Kenny et al.
2010/0140469 A1 6/2010 Nishiguchi
2010/0193682 A1 8/2010 Golikov et al.
2010/0207023 A1 8/2010 Loboda
2010/0301202 A1 12/2010 Vestal
2011/0133073 A1 6/2011 Sato et al.
2011/0168880 A1 7/2011 Ristroph et al.
2011/0180702 A1 7/2011 Flory et al.
2011/0180705 A1 7/2011 Yamaguchi
2011/0186729 A1 8/2011 Verentchikov et al.
2012/0168618 A1 7/2012 Vestal
2012/0261570 A1 10/2012 Shvartsburg et al.
2012/0298853 A1 11/2012 Kurulugama et al.
2013/0048852 A1 2/2013 Verenchikov
2013/0056627 A1* 3/2013 Verenchikov ..... H01J 49/06
250/282
2013/0068942 A1 3/2013 Verenchikov
2013/0161506 A1 6/2013 Ugarov
2013/0187044 A1 7/2013 Ding et al.
2013/0240725 A1 9/2013 Makarov
2013/0248702 A1 9/2013 Makarov
2013/0256524 A1 10/2013 Brown et al.
2013/0313424 A1 11/2013 Makarov et al.
2013/0327935 A1 12/2013 Wiedenbeck
2014/0054454 A1 2/2014 Hoyes et al.
2014/0054456 A1 2/2014 Kinugawa et al.
2014/0084156 A1 3/2014 Ristroph et al.
2014/0117226 A1 5/2014 Giannakopulos
2014/0138538 A1 5/2014 Hieftje et al.
2014/0183354 A1 7/2014 Moon et al.
2014/0191123 A1 7/2014 Wildgoose et al.
2014/0217275 A1 8/2014 Ding
2014/0239172 A1 8/2014 Makarov
2014/0246575 A1 9/2014 Langridge et al.
2014/0291503 A1 10/2014 Shchepunov et al.
2014/0312221 A1 10/2014 Verenchikov et al.
2014/0361162 A1 12/2014 Murray et al.
2015/0028197 A1 1/2015 Grinfeld et al.
2015/0028198 A1 1/2015 Grinfeld et al.
2015/0034814 A1 2/2015 Brown et al.
2015/0048245 A1 2/2015 Vestal et al.
2015/0060656 A1 3/2015 Ugarov
2015/0122986 A1 5/2015 Haase
2015/0194296 A1 7/2015 Verenchikov et al.
2015/0228467 A1 8/2015 Grinfeld et al.
2015/0279650 A1 10/2015 Verenchikov
2015/0294849 A1 10/2015 Grinfeld et al.
2015/0318156 A1 11/2015 Loyd et al.
2015/0364309 A1 12/2015 Welkie
2015/0380233 A1 12/2015 Verenchikov
2016/0005587 A1 1/2016 Verenchikov
2016/0035552 A1 2/2016 Verenchikov
2016/0035558 A1 2/2016 Verenchikov et al.
2016/0079052 A1 3/2016 Makarov et al.
2016/0225598 A1 8/2016 Ristroph
2016/0225602 A1* 8/2016 Ristroph ..... H01J 49/009

(56) References Cited

U.S. PATENT DOCUMENTS

| | | | | |
|---|---|---|---|---|
| 2016/0240363 | A1 | 8/2016 | Verenchikov | |
| 2017/0016863 | A1 | 1/2017 | Verenchikov | |
| 2017/0025265 | A1 | 1/2017 | Verenchikov et al. | |
| 2017/0032952 | A1 | 2/2017 | Verenchikov | |
| 2017/0084443 | A1 | 3/2017 | Willis et al. | |
| 2017/0098533 | A1 | 4/2017 | Stewart et al. | |
| 2017/0168031 | A1 | 6/2017 | Verenchikov | |
| 2017/0229297 | A1 | 8/2017 | Green et al. | |
| 2017/0338094 | A1 | 11/2017 | Verenchikov et al. | |
| 2018/0144921 | A1 | 5/2018 | Hoyes et al. | |
| 2018/0315589 | A1 | 11/2018 | Oshiro | |
| 2018/0366312 | A1* | 12/2018 | Hamish | H01J 49/405 |
| 2019/0180998 | A1 | 6/2019 | Stewart et al. | |
| 2019/0206669 | A1 | 7/2019 | Verenchikov et al. | |
| 2019/0237318 | A1 | 8/2019 | Brown | |
| 2019/0360981 | A1 | 11/2019 | Verenchikov | |
| 2020/0083034 | A1 | 3/2020 | Verenchikov et al. | |
| 2020/0090919 | A1 | 3/2020 | Artaev | |
| 2020/0126781 | A1 | 4/2020 | Kovtoun | |
| 2020/0152440 | A1 | 5/2020 | Hoyes et al. | |
| 2020/0168447 | A1 | 5/2020 | Verenchikov | |
| 2020/0168448 | A1 | 5/2020 | Verenchikov | |
| 2020/0243322 | A1 | 7/2020 | Stewart et al. | |
| 2020/0373142 | A1 | 11/2020 | Verenchikov | |
| 2020/0373143 | A1 | 11/2020 | Verenchikov et al. | |
| 2020/0373145 | A1 | 11/2020 | Verenchikov et al. | |

FOREIGN PATENT DOCUMENTS

| | | | |
|---|---|---|---|
| CN | 102131563 | A | 7/2011 |
| CN | 201946564 | U | 8/2011 |
| DE | 4310106 | C1 | 10/1994 |
| DE | 10116536 | A1 | 10/2002 |
| DE | 102015121830 | A1 | 6/2017 |
| DE | 102019129108 | A1 | 6/2020 |
| DE | 112015001542 | B4 | 7/2020 |
| EP | 0237259 | A2 | 9/1987 |
| EP | 1137044 | A2 | 9/2001 |
| EP | 1566828 | A2 | 8/2005 |
| EP | 1789987 | A1 | 5/2007 |
| EP | 1901332 | A1 | 3/2008 |
| EP | 2068346 | A2 | 6/2009 |
| EP | 1665326 | B1 | 4/2010 |
| EP | 1522087 | B1 | 3/2011 |
| EP | 2599104 | A1 | 6/2013 |
| EP | 1743354 | B1 | 8/2019 |
| EP | 3662501 | A1 | 6/2020 |
| EP | 3662502 | A1 | 6/2020 |
| EP | 3662503 | A1 | 6/2020 |
| GB | 2080021 | A | 1/1982 |
| GB | 2217907 | A | 11/1989 |
| GB | 2300296 | A | 10/1996 |
| GB | 2390935 | A | 1/2004 |
| GB | 2396742 | A | 6/2004 |
| GB | 2403063 | A | 12/2004 |
| GB | 2455977 | A | 7/2009 |
| GB | 2476964 | A | 7/2011 |
| GB | 2478300 | A | 9/2011 |
| GB | 2484361 | B | 4/2012 |
| GB | 2484429 | B | 4/2012 |
| GB | 2485825 | A | 5/2012 |
| GB | 2489094 | A | 9/2012 |
| GB | 2490571 | A | 11/2012 |
| GB | 2495127 | A | 4/2013 |
| GB | 2495221 | A | 4/2013 |
| GB | 2496991 | A | 5/2013 |
| GB | 2496994 | A | 5/2013 |
| GB | 2500743 | A | 10/2013 |
| GB | 2501332 | A | 10/2013 |
| GB | 2506362 | A | 4/2014 |
| GB | 2528875 | A | 2/2016 |
| GB | 2555609 | A | 5/2018 |
| GB | 2556451 | A | 5/2018 |
| GB | 2556830 | A | 6/2018 |
| GB | 2562990 | A | 12/2018 |
| GB | 2575157 | A | 1/2020 |
| GB | 2575339 | A | 1/2020 |
| JP | S6229049 | A | 2/1987 |
| JP | 2000036285 | A | 2/2000 |
| JP | 2000048764 | A | 2/2000 |
| JP | 2003031178 | A | 1/2003 |
| JP | 3571546 | B2 | 9/2004 |
| JP | 2005538346 | A | 12/2005 |
| JP | 2006049273 | A | 2/2006 |
| JP | 2007227042 | A | 9/2007 |
| JP | 2010062152 | A | 3/2010 |
| JP | 4649234 | B2 | 3/2011 |
| JP | 2011119279 | A | 6/2011 |
| JP | 4806214 | B2 | 11/2011 |
| JP | 2013539590 | A | 10/2013 |
| JP | 5555582 | B2 | 7/2014 |
| JP | 2015506567 | B2 | 3/2015 |
| JP | 2015185306 | A | 10/2015 |
| RU | 2564443 | C2 | 10/2015 |
| RU | 2015148627 | A | 5/2017 |
| RU | 2660655 | C2 * | 7/2018 |
| SU | 198034 | | 6/1967 |
| SU | 1681340 | A1 | 9/1991 |
| SU | 1725289 | A1 | 4/1992 |
| WO | 9103071 | A1 | 3/1991 |
| WO | 1998001218 | | 1/1998 |
| WO | 1998008244 | A2 | 2/1998 |
| WO | 200077823 | A2 | 12/2000 |
| WO | 2005001878 | A2 | 1/2005 |
| WO | 2005043575 | A2 | 5/2005 |
| WO | 2006014984 | A1 | 2/2006 |
| WO | 2006049623 | A2 | 5/2006 |
| WO | 2006102430 | A2 | 9/2006 |
| WO | 2006103448 | A2 | 10/2006 |
| WO | 2007044696 | A1 | 4/2007 |
| WO | 2007104992 | A2 | 9/2007 |
| WO | 2007136373 | A1 | 11/2007 |
| WO | 2008046594 | A2 | 4/2008 |
| WO | 2008087389 | A2 | 7/2008 |
| WO | 2010008386 | A1 | 1/2010 |
| WO | 2010138781 | A2 | 12/2010 |
| WO | 2011086430 | A1 | 7/2011 |
| WO | 2011107836 | A1 | 9/2011 |
| WO | 2011135477 | A1 | 11/2011 |
| WO | 2012010894 | A1 | 1/2012 |
| WO | 2012013354 | A1 | 2/2012 |
| WO | 2012023031 | A2 | 2/2012 |
| WO | 2012024468 | A2 | 2/2012 |
| WO | 2012024570 | A2 | 2/2012 |
| WO | 2012116765 | A1 | 9/2012 |
| WO | 2013045428 | A1 | 4/2013 |
| WO | 2013063587 | A2 | 5/2013 |
| WO | 2013067366 | A2 | 5/2013 |
| WO | 2013098612 | A1 | 7/2013 |
| WO | 2013110587 | A | 8/2013 |
| WO | 2013110588 | A2 | 8/2013 |
| WO | 2013124207 | A | 8/2013 |
| WO | 2014021960 | A1 | 2/2014 |
| WO | 2014074822 | A1 | 5/2014 |
| WO | 2014110697 | A | 7/2014 |
| WO | 2014142897 | A1 | 9/2014 |
| WO | 2014152902 | A2 | 9/2014 |
| WO | 2015142897 | A1 | 9/2015 |
| WO | 2015152968 | A1 | 10/2015 |
| WO | 2015153622 | A1 | 10/2015 |
| WO | 2015153630 | A1 | 10/2015 |
| WO | 2015153644 | A1 | 10/2015 |
| WO | 2015175988 | A1 | 11/2015 |
| WO | 2015189544 | A1 | 12/2015 |
| WO | 2016064398 | A1 | 4/2016 |
| WO | 2016174462 | A1 | 11/2016 |
| WO | 2016178029 | A1 | 11/2016 |
| WO | 2017042665 | A1 | 3/2017 |
| WO | 2017087470 | A1 | 5/2017 |
| WO | 2018073589 | A1 | 4/2018 |
| WO | 2018109920 | A1 | 6/2018 |
| WO | 2018124861 | A2 | 7/2018 |
| WO | 2018183201 | A1 | 10/2018 |
| WO | 2019030472 | A1 | 2/2019 |

(56) References Cited

FOREIGN PATENT DOCUMENTS

| | | | |
|---|---|---|---|
| WO | 2019030474 | A1 | 2/2019 |
| WO | 2019030475 | A1 | 2/2019 |
| WO | 2019030476 | A1 | 2/2019 |
| WO | 2019030477 | A1 | 2/2019 |
| WO | 2019058226 | A1 | 3/2019 |
| WO | 2019162687 | A1 | 8/2019 |
| WO | 2019202338 | A1 | 10/2019 |
| WO | 2019229599 | A1 | 12/2019 |
| WO | 2020002940 | A1 | 1/2020 |
| WO | 2020021255 | A1 | 1/2020 |
| WO | 2020121167 | A1 | 6/2020 |
| WO | 2020121168 | A1 | 6/2020 |

OTHER PUBLICATIONS

International Search Report and Written Opinion for International Application No. PCT/US2016/062174 dated Mar. 6, 2017, 8 pages.
IPRP PCT/US2016/062174 dated May 22, 2018, 6 pages.
Search Report for GB Application No. GB1520130.4 dated May 25, 2016.
International Search Report and Written Opinion for International Application No. PCT/US2016/062203 dated Mar. 6, 2017, 8 pages.
IPRP PCT/US2016/062203, dated May 22, 2018, 6 pages.
Search Report for GB Application No. GB1520134.6 dated May 26, 2016.
Search Report Under Section 17(5) for Application No. GB1507363.8 dated Nov. 9, 2015.
International Search Report and Written Opinion of the International Search Authority for Application No. PCT/GB2016/051238 dated Jul. 12, 2016, 16 pages.
IPRP for application PCT/GB2016/051238 dated Oct. 31, 2017, 13 pages.
International Search Report and Written Opinion for International Application No. PCT/US2016/063076 dated Mar. 30, 2017, 9 pages.
IPRP for application PCT/US2016/063076, dated May 29, 2018, 7 pages.
Search Report for GB Application No. 1520540.4 dated May 24, 2016.
IPRP PCT/GB17/51981 dated Jan. 8, 2019, 7 pages.
IPRP for International application No. PCT/GB2018/051206, dated Nov. 5, 2019, 7 pages.
International Search Report and Written Opinion for International Application No. PCT/GB2018/051206, dated Jul. 12, 2018, 9 pages.
Examination Report under Section 18(3) for Application No. GB1906258.7, dated May 5, 2021, 4 pages.
Author unknown, "Electrostatic lens ," Wikipedia, Mar. 31, 2017 (Mar. 31, 2017), XP055518392, Retrieved from the Internet:URL: https://en.wikipedia.org/w/index.php?title=Electrostatic_lens&oldid=773161674 [retrieved on Oct. 24, 2018].
Hussein, O.A. et al., "Study the most favorable shapes of electrostatic quadrupole doublet lenses", AIP Conference Proceedings, vol. 1815, Feb. 17, 2017 (Feb. 17, 2017), p. 110003.
Guan S., et al. "Stacked-ring electrostatic ion guide" Journal of the American Society for Mass Spectrometry, Elsevier Science Inc, 7(1):101-106 (1996). Abstract.
International Search Report and Written Opinion for application No. PCT/GB2018/052104, dated Oct. 31, 2018, 14 pages.
International Search Report and Written Opinion for application No. PCT/GB2018/052105, dated Oct. 15, 2018, 18 pages.
International Search Report and Written Opinion for application PCT/GB2018/052100, dated Oct. 19, 2018, 19 pages.
International Search Report and Written Opinion for application PCT/GB2018/052102, dated Oct. 25, 2018, 14 pages.
International Search Report and Written Opinion for application No. PCT/GB2018/052099, dated Oct. 10, 2018, 16 pages.
International Search Report and Written Opinion for application No. PCT/GB2018/052101, dated Oct. 19, 2018, 15 pages.
Combined Search and Examination Report under Sections 17 and 18(3) for application GB1807605.9 dated Oct. 29, 2018, 5 pages.
Combined Search and Examination Report under Sections 17 and 18(3) for application GB1807626.5, dated Oct. 29, 2018, 7 pages.
Yavor, M.I., et al., "High performance gridless ion mirrors for multi-reflection time-of-flight and electrostatic trap mass analyzers", International Journal of Mass Spectrometry, vol. 426, Mar. 2018, pp. 1-11.
Search Report under Section 17(5) for application GB1707208.3, dated Oct. 12, 2017, 5 pages.
Communication Relating to the Results of the Partial International Search for International Application No. PCT/GB2019/01118, dated Jul. 19, 2019, 25 pages.
Doroshenko, V.M., and Cotter, R.J., "Ideal velocity focusing in a reflectron time-of-flight mass spectrometer", American Society for Mass Spectrometry, 10(10):992-999 (1999).
Kozlov, B. et al. "Enhanced Mass Accuracy in Multi-Reflecting TOF MS" www.waters.com/posters, ASMS Conference (2017).
Kozlov, B. et al. "Multiplexed Operation of an Orthogonal Multi-Reflecting TOF Instrument to Increase Duty Cycle by Two Orders" ASMS Conference, San Diego, CA, Jun. 6, 2018.
Kozlov, B. et al. "High accuracy self-calibration method for high resolution mass spectra" ASMS Conference Abstract, 2019.
Kozlov, B. et al. "Fast Ion Mobility Spectrometry and High Resolution TOF MS" ASMS Conference Poster (2014).
Verenchicov., A. N. "Parallel MS-MS Analysis in a Time-Flight Tandem. Problem Statement, Method, and nstrucmental Schemes" Institute for Analytical Instrucmentation RAS, Saint-Petersburg, (2004) Abstract.
Yavor, M. I. "Planar Multireflection Time-of-Flight Mass Analyser with Unlimited Mass Range" Institute for Analytical Instrucmentation RAS, Saint-Petersburg, (2004) Abstract.
Khasin, Y. I. et al. "Initial Experimenatl Studies of a Planar Multireflection Time-of-Flight Mass Spectrometer" Institute for Analytical Instrucmentation RAS, Saint-Petersburg, (2004) Abstract.
Verenchicov., A. N. et al. "Stability of Ion Motion in Periodic Electrostatic Fields" Institute for Analytical Instrucmentation RAS, Saint-Petersburg, (2004) Abstract.
Verenchicov., A. N. "The Concept of Multireflecting Mass Spectrometer for Continuous Ion Sources" Institute for Analytical Instrucmentation RAS, Saint-Petersburg, (2006) Abstract.
Verenchicov., A. N., et al. "Accurate Mass Measurements for Inerpreting Spectra of atmospheric Pressure Ionization" Institute for Analytical Instrucmentation RAS, Saint-Petersburg, (2006) Abstract.
Kozlov, B. N. et al., "Experimental Studies of Space Charge Effects in Multireflecting Time-of-Flight Mass Spectrometes" Institute for Analytical Instrucmentation RAS, Saint-Petersburg, (2006) Abstract.
Kozlov, B. N. et al., "Multireflecting Time-of-Flight Mass Spectrometer With an Ion Trap Source" Institute for Analytical Instrucmentation RAS, Saint-Petersburg, (2006) Abstract.
Hasin, Y. I., et al., "Planar Time-of-Flight Multireflecting Mass Spectrometer with an Orthogonal Ion Injection Out of Continuous Ion Sources" Institute for Analytical Instrucmentation RAS, Saint-Petersburg, (2006) Abstract.
Lutvinsky Y. I. et al., "Estimation of Capacity of High Resolution Mass Spectra for Analysis of Complex Mixtures" Institute for Analytical Instrucmentation RAS, Saint-Petersburg, (2006) Abstract.
Verenchicov., A. N. et al. "Multiplexing in Multi-Reflecting TOF MS" Journal of Applied Solution Chemistry and Modeling, 6:1-22(2017).
Supplementary Partial EP Search Report for EP Application No. 16869126.9, dated Jun. 13, 2019.
Supplementary Partial EP Search Report for EP Application No. 16866997.6, dated Jun. 7, 2019.
"Reflectron—Wikipedia", Oct. 9, 2015, Retrieved from the Internet: URL:https://en.wikipedia.org/w/index.php?t itle=Reflectron&oldid=684843442 [retrieved on May 29, 2019].
Scherer, S., et al., "A novel principle for an ion mirror design in time-of-flight mass spectrometry", International Journal of Mass Spectrometry, Elsevier Science Publishers, Amsterdam, NL, vol. 251, No. 1, Mar. 15, 2006.

(56) References Cited

OTHER PUBLICATIONS

International Search Report and Written Opinion for International Application No. PCT/EP2017/070508 dated Oct. 16, 2017, 17 pages.
Search Report for United Kingdom Application No. GB1613988.3 dated Jan. 5, 2017, 4 pages.
Sakurai et al., "A New Multi-Passage Time-of-Flight Mass Spectrometer at JAIST", Nuclear Instruments & Methods in Physics Research, Section A, Elsevier, 427(1-2): 182-186, May 11, 1999. Abstract.
Toyoda et al., "Multi-Turn-Time-of-Flight Mass Spectometers with Electrostatic Sectors", Journal of Mass Spectrometry, 38:1125-1142, Jan. 1, 2003.
Wouters et al., "Optical Design of the TOFI (Time-of-Flight Isochronous) Spectrometer for Mass Measurements of Exotic Nuclei", Nuclear Instruments and Methods in Physics Research, Section A, 240(1): 77-90, Oct. 1, 1985.
Stresau, D., et al.: "Ion Counting Beyond 10ghz Using a New Detector and Conventional Electronics", European Winter Conference on Plasma Spectrochemistry, Feb. 4-8, 2001, Lillehammer, Norway, Retrieved from the Internet:www.etp-ms.com/file-repository/21 [retrieved on Jul. 31, 2019].
Kaufmann, R., et al., "Sequencing of peptides in a time-of-flight mass spectrometer:evaluation of postsource decay following matrix-assisted laser desorption ionisation (MALDI)", International Journal of Mass Spectrometry and Ion Processes, Elsevier Scientific Publishing Co. Amsterdam, NL, 131:355-385, Feb. 24, 1994.
Barry Shaulis et al: "Signal linearity of an extended range pulse counting detector: Applications to accurate and precise U-Pb dating of zircon by laser ablation quadrupole ICP-MS", G3: Geochemistry, Geophysics, Geosystems, 11(11):1-12, Nov. 20, 2010.
Search Report for United Kingdom Application No. GB1708430.2 dated Nov. 28, 2017.
International Search Report and Written Opinion for International Application No. PCT/GB2018/051320 dated Aug. 1, 2018.
International Search Report and Written Opinion for International Application No. PCT/GB2019/051839 dated Sep. 18, 2019.
International Search Report and Written Opinion for International Application No. PCT/GB2019/051234 dated Jul. 29, 2019, 5 pages.
Combined Search and Examination Report for United Kingdom Application No. GB1901411.7 dated Jul. 31, 2019.
Extended European Search Report for EP Patent Application No. 16866997.6, dated Oct. 16, 2019.
Combined Search and Examination Report for GB 1906258.7, dated Oct. 25, 2019.
Combined Search and Examination Report for GB1906253.8, dated Oct. 30, 2019, 5 pages.
Search Report under Section 17(5) for GB1916445.8, dated Jun. 15, 2020.
International Search Report and Written Opinion for International application No. PCT/GB2020/050209, dated Apr. 28, 2020, 12 pages.
Author unknown, "Einzel Lens", Wikipedia [online] Nov. 2020 [retrieved on Nov. 3, 2020]. Retrieved from Internet URL: https://en.wikipedia.org/wiki/Einzel_lens, 2 pages.
International Search Report and Written Opinion for International application No. PCT/GB2019/051235, dated Sep. 25, 2019, 22 pages.
International Search Report and Written Opinion for International application No. PCT/GB2019/051416, dated Oct. 10, 2019, 22 pages.
Search and Examination Report under Sections 17 and 18(3) for Application No. GB1906258.7, dated Dec. 11, 2020, 7 pages.
Carey, D.C., "Why a second-order magnetic optical achromat works", Nucl. Instrum. Meth., 189(203):365-367 (1981).
Yavor, M., "Optics of Charged Particle Analyzers", Advances in Imaging and Electron Physics Book Series, vol. 57(2009) Abstract.
Sakurai, T. et al., "Ion optics for time-of-flight mass spectrometers with multiple symmetry", Int J Mass Spectrom Ion Proc 63(2-3):273-287 (1985).
Wollnik, H., "Optics of Charged Particles", Acad. Press, Orlando, FL (1987) Abstract.
Wollnik, H., and Casares, A., "An energy-isochronous multi-pass time-of-flight mass spectrometer consisting of two coaxial electrostatic mirrors", Int J Mass Spectrom 227:217-222 (2003).
O'Halloran, G.J., et al., "Determination of Chemical Species Prevalent in a Plasma Jet", Bendix Corp Report ASD-TDR-62-644, U.S. Air Force (1964). Abstract.
Examination Report for United Kingdom Application No. GB1618980.5 dated Jul. 25, 2019.
Communication pursuant to Article 94(3) EPC for Application No. 16867005.7, dated Jul. 1, 2021, 6 pages.
Collision Frequency, https://en.wikipedia.org/wiki/Collision_frequency accessed Aug. 17, 2021.
International Search Report and Written Opinion for International Application No. PCT/GB2020/050471, dated May 13, 2020, 9 pages.
Search Report for GB Application No. GB1903779.5, dated Sep. 20, 2019.
Search Report for GB Application No. GB2002768.6 dated Jul. 7, 2020.

* cited by examiner

MULTI-REFLECTING TIME OF FLIGHT MASS ANALYSER

CROSS-REFERENCE TO RELATED APPLICATIONS

This application is a U.S. national phase filing claiming the benefit of and priority to International Patent Application No. PCT/GB2019/051234, filed on May 3, 2019, which claims priority from and the benefit of United Kingdom patent application No. 1807605.9 filed on May 10, 2018. The entire contents of these applications are incorporated herein by reference.

FIELD OF THE INVENTION

The present invention relates generally to Multi-Reflecting Time of Flight (MRTOF) mass analysers or mass separators, and in particular to techniques for controlling the number of ion reflections between the ion mirrors.

BACKGROUND

Time of Flight (TOF) mass analysers use an ion accelerator to pulse ions into a time of flight region towards a detector. The duration of time between an ion being pulsed and being detected at the detector is used to determine the mass to charge ratio of that ion. In order to increase the resolving power of a time-of-flight mass analyser it is necessary to increase the flight path length of the ions.

Multi-reflecting TOF mass analysers are known in which ions are reflected multiple times between ion mirrors in a time of flight region, so as to provide a relatively long ion flight path to the detector. Due to the initial conditions of the ions at the ion accelerator, the trajectories of the ions tend to diverge as they pass through the mass analyser. It is known to provide a periodic lens between the ion mirrors so as to control the trajectories of the ions through the. However, the periodic lens introduces aberrations to the ion flight times, which restricts the resolving power of the instrument.

Furthermore, sources of degradation of the spectral resolution other than the initial ion conditions occur.

SUMMARY

From a first aspect the present invention provides a mass spectrometer comprising: a multi-reflecting time of flight (MRTOF) mass analyser or mass separator having two gridless ion mirrors that are elongated in a first dimension (z-dimension) and configured to reflect ions multiple times in a second orthogonal dimension (x-dimension) as the ions travel in the first dimension; and a controller configured to operate the spectrometer in: (i) a first mode for mass analysing or mass separating ions having a first rate of interaction with background gas molecules in the mass analyser or separator, in which the velocities of ions in the first dimension (z-dimension) through the mass analyser or separator and/or second dimension (x-dimension) between the mirrors are controlled such that the ions are reflected a first number of times between the ion mirrors; and (ii) a second mode for mass analysing or mass separating ions having a second, higher rate of interaction with background gas molecules in the mass analyser or separator, in which the velocities of the ions in the first dimension (z-dimension) through the mass analyser or separator and/or second dimension (x-dimension) between the mirrors are controlled such that ions are reflected a second number of times between the ion mirrors that is lower than said first number of times.

The inventors have recognised that as different types of ions have different degrees of interaction with background gas molecules in the mass analyser or separator, it may be desirable to cause the different types of ions to undergo different numbers of ion mirror reflections such that the different types of ions have different flight path lengths through the mass analyser or separator. For example, the different types of ions may have different probabilities of colliding with residual gas molecules in the mass analyser or mass separator, i.e. have different collisional cross-sectional areas. Alternatively, or additionally, one of the types of ions may be more labile and more likely to fragment upon collisions (or even fragment anyway, e.g. by metastable unimolecular processes) than other types of ions.

The first mode enables ions to be reflected between the ion mirrors a relatively high number of times so that the flight path length for these ions is relatively high. This enables ions to be mass analysed or separated with high resolution. The second mode enables ions to be reflected between the ion mirrors a relatively low number of times so that the flight path length for these ions is relatively low. Although it would be expected that the second mode provides a lower mass resolution or lower ion separation than the first mode for a given type of ion, the shorter path length of the second mode means that these ions undergo a relatively low number of collisions with the background gas and hence will be scattered (and/or fragmented) less. The second mode may therefore increase the resolution with which these ions are resolved, as compared to the first mode. This technique may also be used to ensure that substantially all of the ions analysed in the second mode undergo the same number of ion mirror reflections.

In the first mode of the invention, the ratio of the average speed of the ions in the first dimension (z-dimension) through the mass analyser or separator to the average speed of the ions in the second dimension (x-dimension) between the mirrors may be controlled such that the ions are reflected said first number of times between the ion mirrors. In the second mode, the ratio of the average speed of the ions in the first dimension (z-dimension) through the mass analyser or separator to the average speed of the ions in the second dimension (x-dimension) between the mirrors may be controlled such that the ions are reflected said second number of times between the ion mirrors.

The average speed of the ions in the first dimension (z-dimension) through the mass analyser or separator may be varied between the first and second modes so as to alter said ratio. Alternatively, or additionally, the average speed of the ions in the second dimension (x-dimension) between the ion mirrors may be varied between the first and second modes so as to alter said ratio between the first and second modes.

Said first number of times may be the total number of times, in the first mode, that the ions are reflected in the ion mirrors between entering the mass analyser or separator and impacting an ion detector in the mass analyser or separator (or leaving the mass separator). Similarly, said second number of times may be the total number of times, in the second mode, that the ions are reflected in the ion mirrors between entering the mass analyser or separator and impacting an ion detector in the mass analyser or separator (or leaving the mass separator).

For the avoidance of doubt, a gridless ion mirror is an ion mirror that does not have any grid electrodes arranged in the ion path within the ion mirror. The use of gridless ion mirrors enables ions to be reflected multiple times within the ion mirrors without the mirrors attenuating or scattering the ion beam, which may be particularly problematic in MRTOF instruments.

The two ions mirrors may be configured to reflect ions over substantially the same length in the first dimension (z-dimension). This enables great flexibility in the number of ion mirror reflections that may be performed in the first and second modes, and simplifies construction and operation of the instrument.

The mass analyser or mass separator may comprise an ion accelerator for accelerating ions into one of the ion mirrors and that is arranged between the ion mirrors; and/or comprising an ion detector for detecting ions after having been reflected by the ion mirrors and that is arranged between the ion mirrors. The arrangement of the ion accelerator and/or detector between the ion mirrors enables the effect of the fringe fields of the ion mirrors on the ions to be avoided.

The ion accelerator and/or detector may be arranged substantially midway, in the second dimension (x-dimension) between the ion mirrors. This may facilitate the use of simple ion mirrors. For example, the ions mirrors may be substantially symmetrical about a plane defined by the first dimension and a third dimension that is orthogonal to the first and second dimensions (i.e. the y-z plane).

To minimize aberrations due to the spread of ions in the first dimension (z-dimension), the gridless mirrors may not vary in size or electrical potential along the first dimension, except for at the edges of the mirror (in the first dimension).

The means for directing the ions into the mirror (e.g. the ion accelerator) may be arranged so that the first point of ion entry into either ion mirror is spaced from the leading edge of that ion mirror, in the first dimension, such that all ions travelling through the mirror have the same conditions independent of their coordinate in the first dimension.

The means for receiving the ions from the mirrors (e.g. the detector) may be arranged so that the final point of ion exit from either ion mirror is spaced from the trailing edge of that ion mirror, in the first dimension, such that all ions travelling through the mirror have the same conditions independent of their coordinate in the first dimension.

For example, the mass analyser or mass separator may be configured such that the first point of ion entry into either ion mirror is at a distance from both ends of that ion mirror, in the first dimension (z-dimension), that is greater than 2H, where H is the largest internal dimension of the ion mirror in a third dimension (y-dimension) that is orthogonal to the first and second dimensions. The final point that the ions exit either mirror may also be a distance from both ends of that ion mirror, in the first dimension (z-dimension), that is greater than 2H, The ion mirrors may have translation symmetry along first dimension (z-dimension), i.e. no changes in size between the points at which the ions first enter and finally exit the ion mirror. This helps avoid perturbations in first-dimension.

The mass analyser or separator may be configured to be maintained at a pressure of: $\geq 1\times10^{-8}$ mbar, $\geq 2\times10^{-8}$ mbar, $\geq 3\times10^{-8}$ mbar, $\geq 4\times10^{-8}$ mbar, $\geq 5\times10^{-8}$ mbar, $\geq 6\times10^{-8}$ mbar, $\geq 7\times10^{-8}$ mbar, $\geq 8\times10^{-8}$ mbar, $\geq 9\times10^{-8}$ mbar, $\geq 1\times10^{-7}$ mbar, $\geq 5\times10^{-7}$ mbar, $\geq 1\times10^{-6}$ mbar, $\geq 5\times10^{-6}$ mbar, $\geq 1\times10^{-5}$ mbar, $\geq 5\times10^{-5}$ mbar, $\geq 1\times10^{-4}$ mbar, $\geq 5\times10^{-4}$ mbar, $\geq 1\times10^{-3}$ mbar, $\geq 5\times10^{-3}$ mbar, or $\geq 1\times10^{-2}$ mbar.

It is also contemplated that the mass analyser or separator may be configured to be maintained at a pressure of: $\geq 1\times10^{-11}$ mbar, $\geq 5\times10^{-11}$ mbar, $\geq 1\times10^{-10}$ mbar, $\geq 5\times10^{-10}$ mbar, $\geq 1\times10^{-9}$ mbar, or $\geq 5\times10^{-9}$ mbar.

The use of the two modes becomes more significant as the background gas pressure in the mass analyser or separator increases, as the ions interact at a higher rate with the background gas molecules and may therefore scatter more.

Alternatively, or additionally, to the pressures above, the mass analyser or separator may configured to be maintained at a pressure of: $\leq 1\times10^{-11}$ mbar, $\leq 5\times10^{-11}$ mbar, $\leq 1\times10^{-10}$ mbar, $\leq 5\times10^{-10}$ mbar, $\leq 1\times10^{-9}$ mbar, $\leq 5\times10^{-9}$ mbar, $\leq 1\times10^{-8}$ mbar, $\leq 2\times10^{-8}$ mbar, $\leq 3\times10^{-8}$ mbar, $\leq 4\times10^{-8}$ mbar, $\leq 5\times10^{-8}$ mbar, $\leq 6\times10^{-8}$ mbar, $\leq 7\times10^{-8}$ mbar, $\leq 8\times10^{-8}$ mbar, $\leq 9\times10^{-8}$ mbar, $\leq 1\times10^{-7}$ mbar, $\leq 5\times10^{-7}$ mbar, $\leq 1\times10^{-6}$ mbar, $\leq 5\times10^{-6}$ mbar, $\leq 1\times10^{-5}$ mbar, $\leq 5\times10^{-5}$ mbar, $\leq 1\times10^{-4}$ mbar, $\leq 5\times10^{-4}$ mbar, $\leq 1\times10^{-3}$ mbar, $\leq 5\times10^{-3}$ mbar, $\leq 1\times10^{-2}$ mbar.

The first number of times that the ions are reflected in the ion mirrors is greater than said second number of times by a factor of: ≥2, ≥3, ≥4, ≥5, ≥6, ≥7, ≥8, ≥9, ≥10, ≥11, ≥12, ≥13, ≥14, ≥15, ≥16, ≥17, ≥18, ≥19, or ≥20.

Said first number of times that the ions are reflected in the ion mirrors may be: ≥5, ≥6, ≥7, ≥8, ≥9, ≥10, ≥11, ≥12, ≥13, ≥14, ≥15, ≥16, ≥17, ≥18, ≥19, or ≥20.

Said second number of times that the ions are reflected in the ion mirrors may be: ≥2, ≥3, ≥4, ≥5, ≥6, ≥7, ≥8, ≥9, or ≥10.

The controller may be configured such that substantially all of the ions analysed in the first mode undergo the same number of reflections in the ion mirrors and/or substantially all of the ions analysed in the second mode may undergo the same number of reflections in the ion mirrors.

The controller may be configured such that in the first mode the ions have velocities in the first dimension (z-dimension) through the mass analyser or separator in a first range, and in the second mode the ions have velocities in the first dimension (z-dimension) through the mass analyser or separator in a second, lower range; and/or the controller may be configured such that in the first mode the ions have speeds in the second dimension (x-dimension) between the ion mirrors in a first range, and in the second mode the ions have speeds in the second dimension (x-dimension) between the ions mirrors in a second, lower range.

The ions may enter the mass analyser or separator along an axis that is in the first dimension (z-dimension).

As described above, the controller may be configured such the ions have different velocities in the first dimension (z-dimension) through the mass analyser or separator in the first and second modes.

As such, the spectrometer may comprise electrodes and one or more voltage supply configured to apply a potential difference between the electrodes that accelerates or decelerates the ions such that in the first mode ions enter the MRTOF mass analyser or mass separator with said velocities in the first dimension (z-dimension) such that the ions are reflected said first number of times, and in the second mode ions enter the MRTOF mass analyser or mass separator with said velocities in the first dimension (z-dimension) such that the ions are reflected said second number of times.

Alternatively or additionally, the controller may be configured such the ions have different average speeds in the second dimension (x-dimension) in the first and second modes. This may be achieved, for example, by varying one or more voltage applied to one or more of the ion mirrors between the first and second modes and/or, if an orthogonal accelerator is used to accelerate ions into the ion mirrors, by varying one or more voltage applied to the orthogonal accelerator between the first and second modes.

The spectrometer may comprise a deflection module within the MRTOF mass analyser or separator that is configured to deflect the average trajectory of the ions in the first and/or second mode such that in the first mode the ions have velocities in the first dimension (z-dimension) through the mass analyser or separator in a first range; and in the second mode the ions have velocities in the first dimension (z-dimension) through the mass analyser or separator in a second higher range.

It will therefore be appreciated that the deflection module deflects the average trajectory of the ions in the first and/or second mode such that in the first mode the ions have average speeds in the second dimension (x-dimension) in a first range; and in the second mode the ions have average speeds in the second dimension (x-dimension) in a second lower range.

The deflection module may comprise one or more electrode, and a voltage supply connected thereto; wherein the deflection module is configured to apply one or more voltage to the one or more electrode such that in the first mode the mean trajectory of the ions leaving the deflection module is at a relatively small acute angle to the second dimension (x-dimension) and in the second mode is at a relatively large acute angle to the second dimension (x-dimension).

The may comprise an orthogonal accelerator configured to receive ions along an ion receiving axis and accelerate those ions orthogonally to the ion receiving axis and towards one of the ion mirrors, wherein the deflection module is arranged downstream of the orthogonal accelerator.

The orthogonal accelerator may be configured to receive ions along an ion receiving axis that is arranged at an acute angle to the first dimension (z-dimension), and the deflection module may be configured such that in either the first or second mode it deflects the average trajectory of the ions leaving the orthogonal accelerator towards the second dimension (x-dimension) by said acute angle.

The deflection module could be used in its own right to cause ions to have greater or fewer ion-mirror reflections irrespective of the incident angle of the ions at the orthogonal accelerator.

The spectrometer described herein may comprise an orthogonal accelerator configured to receive ions along an ion receiving axis and accelerate those ions orthogonally to the ion receiving axis; and wherein either: (i) the ion receiving axis is parallel to the first dimension (z-dimension); or (ii) the ion receiving axis is at an acute angle to the first dimension (z-dimension).

The orthogonal accelerator may be configured to pulse ions in a series of pulses, wherein the timings of the pulses are determined by an encoding sequence that varies the duration of the time interval between adjacent pulses as the series of pulses progresses; and wherein the spectrometer comprises a processor configured to use the timings of the pulses in the encoding sequence to determine which ion data detected at a detector relate to which ion accelerator pulse so as to resolve spectral data obtained from the different ion accelerator pulses.

The ion accelerator may be configured to pulse ions towards the detector at a rate such that some of the ions pulsed towards the detector in any given pulse arrive at the detector after some of the ions that are pulsed towards the detector in a subsequent pulse.

The spectrometer may comprise a molecular weight filter or ion separator arranged upstream of the MRTOF mass analyser or mass separator, wherein the controller is configured to synchronise the molecular weight filter or ion separator with the mass analyser or mass separator such that, in use, ions having the first rate of interaction with the background gas molecules are transmitted into the MRTOF mass analyser or mass separator whilst it is controlled to be in the first mode and ions having the second, higher rate of interaction with the background gas molecules are transmitted into the MRTOF mass analyser or mass separator when it is controlled to be in the second mode.

For example, the controller may be configured to synchronise the molecular weight filter or ion separator with the mass analyser or mass separator such that, in use, ions having a first range of molecular weights are transmitted into the MRTOF mass analyser or mass separator whilst it is controlled to be in the first mode and ions having the second, higher range of molecular weights are transmitted into the MRTOF mass analyser or mass separator when it is controlled to be in the second mode.

However, it is contemplated that the ion separator may separate the ions by a physico-chemical property (other than molecular weight) which determines the rate of interaction of those ions with the background gas molecules.

The ion separator may be an ion mobility separation (IMS) device arranged upstream of the mass analyser or mass separator so as to deliver ions to the mass analyser mass separator in order of ion mobility. The mass analyser or mass separator may be synchronised with the IMS device such that higher mobility ions eluting from the IMS device are analysed in the first mode and lower mobility ions eluting from the IMS device are analysed in the second mode.

The ion separator may spatially separate the ions and transmit all of the separated ions. Alternatively, the ion separator may be a filter configured to (only) transmit ions having a certain range of rates of interaction with the background gas molecules at any given time and filters out other ions, wherein the range that is transmitted varies with time.

The ion separator may be a mass separator, such as a quadrupole mass filter that varies the mass to charge ratios transmitted with time.

It is contemplated that the mass analyser or mass separator may be operated in one or more further modes of operation in which a third or further different number of ion-mirror reflections are performed, respectively. The mass analyser or mass separator may be synchronised with the ion separator such that the mass analyser or mass separator is switched between the different modes whilst the ions elute from the ion separator. For example, the mass analyser or mass separator may switch modes as the ions elute such that the number of ion mirror reflections in sequential modes are progressively decreased. This may ensure the optimum number of ion mirror reflections and highest resolution possible for each type of ion eluting. Separate spectra may be acquired during each mode.

Embodiments are contemplated in which the controller is set up and configured to repeatedly alternate the spectrometer between the first and second modes during a single experimental run. This may optimise the analysis of both low and high molecular weight ions in a sample.

The mass analyser or separator may be configured such that ions are substantially not spatially focussed and/or collimated in the first dimension (z-dimension) as the ions travel between the ion mirrors; or the mass analyser or separator may be configured such that there are substantially no aberrations due to spatial focusing in the first dimension (z-dimension) as the ions travel between the ion mirrors.

For example, the spectrometer may be configured such that: (i) ions are substantially not spatially focussed and/or collimated in the first dimension (z-dimension) within the mass analyser or separator; or (ii) ions are not periodically focussed and/or collimated in the first dimension (z-dimension) within the mass analyser or separator; or (iii) ions are substantially not spatially focussed and/or collimated in the first dimension (z-dimension) within the mass analyser or separator after the first ion-mirror reflection. This is in contrast to conventional MRTOF mass analysers, which include a periodic lens array between the ions mirrors for focussing ions in the first dimension (z-dimension). Embodiments of the present invention therefore avoid the time of flight aberrations associated with periodic lens arrays.

The mass analyser or mass separator is considered to be novel in its own right. Accordingly, from a second aspect the present invention provides a multi-reflecting time of flight (MRTOF) mass analyser or mass separator having two gridless ion mirrors that are elongated in a first dimension (z-dimension) and configured to reflect ions multiple times in a second orthogonal dimension (x-dimension) as the ions travel in the first dimension; and a controller configured to operate the mass analyser or mass separator in: (i) a first mode for mass analysing or mass separating ions having a first rate of interaction with background gas molecules in the mass analyser or separator, in which the velocities of ions in the first dimension (z-dimension) through the mass analyser or separator and/or second dimension (x-dimension) between the mirrors are controlled such that the ions are reflected a first number of times (N) between the ion mirrors; and (ii) a second mode for mass analysing or mass separating ions having a second, higher rate of interaction with background gas molecules in the mass analyser or separator, in which the velocities of ions in the first dimension (z-dimension) through the mass analyser or separator and/or second dimension (x-dimension) between the mirrors are controlled such that the ions are reflected a second number of times between the ion mirrors that is lower than said first number of times.

The mass analyser or mass separator may have any of the features discussed herein, e.g. in relation to the first aspect of the present invention.

The present invention also provides a method of mass spectrometry or mass separation comprising: providing a spectrometer as described herein, or a mass analyser or mass separator as described herein; operating the spectrometer, or mass analyser or mass separator, in the first mode in which the velocities of the ions in the first dimension (z-dimension) through the mass analyser or separator and/or second dimension (x-dimension) between the mirrors are controlled such that ions having a first rate of interaction with background gas molecules in the mass analyser or separator are reflected a first number of times between the ion mirrors; and operating the spectrometer, or mass analyser or mass separator, in the second mode in which the velocities of the ions in the first dimension (z-dimension) through the mass analyser or separator and/or second dimension (x-dimension) between the mirrors are controlled such that ions having a second, higher rate of interaction with background gas molecules in the mass analyser or separator are reflected a second number of times between the ion mirrors that is lower than said first number of times.

The rate of interaction with the background molecules may be the mean number of interactions (e.g. collisions) per unit path length the ion travels in the mass analyser or mass separator.

The method may comprise any of the features described herein, e.g. in relation to the first aspect of the present invention.

For example, said first number of times that the ions are reflected in the ion mirrors may be greater than said second number of times by a factor of: ≥2, ≥3, ≥4, ≥5, ≥6, ≥7, ≥8, ≥9, ≥10, ≥11, ≥12, ≥13, ≥14, ≥15, ≥16, ≥17, ≥18, ≥19, or ≥20.

All of the ions analysed in the first mode may undergo the same number of reflections in the ion mirrors and/or substantially all of the ions analysed in the second mode may undergo the same number of reflections in the ion mirrors.

In the first mode, the ions may have velocities in the first dimension (z-dimension) through the mass analyser or separator in a first range; and in the second mode the ions may have velocities in the first dimension (z-dimension) through the mass analyser or separator in a second, higher range. Alternatively or additionally, the ions may be caused to have different average speeds in the second dimension (x-dimension) in the first and second modes. This may be achieved, for example, by varying one or more voltage applied to one or more of the ion mirrors between the first and second modes and/or, if an orthogonal accelerator is used to accelerate ions into the ion mirrors, by varying one or more voltage applied to the orthogonal accelerator between the first and second modes.

The ions may enter the mass analyser or separator along an axis that is in the first dimension (z-dimension).

Ions may be accelerated or decelerated, e.g. by a potential difference, such that in the first mode ions enter the MRTOF mass analyser or mass separator with said velocities in the first dimension (z-dimension) such that the ions are reflected said first number of times, and in the second mode ions enter the MRTOF mass analyser or mass separator with said velocities in the first dimension (z-dimension) such that the ions are reflected said second number of times.

A deflection module within the MRTOF mass analyser or separator may deflect the average trajectory of the ions in the first and/or second mode such that in the first mode the ions have velocities in the first dimension (z-dimension) through the mass analyser or separator in a first range; and in the second mode the ions have velocities in the first dimension (z-dimension) through the mass analyser or separator in a second higher range.

The deflection module may apply one or more voltage to one or more electrode such that in the first mode the mean trajectory of the ions leaving the deflection module is caused to be at a relatively small acute angle to the second dimension (x-dimension) and in the second mode is caused to be at a relatively large acute angle to the second dimension (x-dimension).

An orthogonal accelerator may be used to receive ions along an ion receiving axis and accelerate those ions orthogonally to the ion receiving axis and towards one of the ion mirrors. The deflection module may be arranged downstream of the orthogonal accelerator such that it received ions from the orthogonal accelerator.

The orthogonal accelerator may receive ions along an ion receiving axis that is arranged at an acute angle to the first dimension (z-dimension), and the deflection module (in either the first or second mode) may deflect the average trajectory of the ions leaving the orthogonal accelerator towards the second dimension (x-dimension) by said acute angle.

The orthogonal accelerator may pulse ions in a series of pulses, wherein the timings of the pulses are determined by an encoding sequence that varies the duration of the time interval between adjacent pulses as the series of pulses progresses; and the timings of the pulses in the encoding sequence may be used to determine which ion data detected at a detector relate to which ion accelerator pulse so as to resolve spectral data obtained from the different ion accelerator pulses.

The ion accelerator may pulse ions towards the detector at a rate such that some of the ions pulsed towards the detector in any given pulse arrive at the detector after some of the ions that are pulsed towards the detector in a subsequent pulse.

The method may comprise operating the spectrometer in the first mode when first ions having a relatively low degree of interaction with background gas molecules in the mass analyser or separator enter the mass analyser or separator; and operating the spectrometer in the second mode when second ions having a relatively high degree of interaction with the background gas molecules in the mass analyser or separator enter the mass analyser or separator.

The first ions may have a lower molecular weight than the second ions.

The first ions may have a lower collisional cross-section with the background gas molecules than the second ions.

The method may comprise providing ions to the mass analyser or mass separator that are separated by a physico-chemical property that determines the rate of interaction of the ions with the background gas molecules; operating in said first mode whilst ions having a first range of values of said physico-chemical property are transmitted into the MRTOF mass analyser or mass separator; and operating in said second mode whilst ions having a second range of values of said physico-chemical property are transmitted into the MRTOF mass analyser or mass separator.

For example, the physico-chemical property may be ion mobility, molecular weight, or mass to charge ratio. This may optimise the analysis of both low and high molecular weight ions in a sample.

The ions may not be spatially focussed and/or collimated in the first dimension (z-dimension) as the ions travel between the ion mirrors. For example, ions may not be spatially focussed and/or collimated in the first dimension (z-dimension) within the mass analyser or separator; or may not be spatially focussed and/or collimated in the first dimension (z-dimension) within the mass analyser or separator after the first ion-mirror reflection. This is in contrast to conventional MRTOF mass analysers, which include a periodic lens array between the ions mirrors for focussing ions in the first dimension (z-dimension). Embodiments of the present invention therefore avoid the time of flight aberrations associated with periodic lens arrays.

It is contemplated that the ion mirrors need not necessarily be gridless ion mirrors. Accordingly, from a third aspect the present invention provides a multi-reflecting time of flight (MRTOF) mass spectrometer, mass analyser or mass separator having two ion mirrors that are elongated in a first dimension (z-dimension) and configured to reflect ions multiple times in a second orthogonal dimension (x-dimension) as the ions travel in the first dimension; and a controller configured to operate the spectrometer in: (i) a first mode in which the velocities of the ions in the first dimension (z-dimension) through the mass analyser or separator and/or second dimension (x-dimension) between the mirrors are controlled such that the ions are reflected a first number of times between the ion mirrors; and (ii) a second mode in which the velocities of the ions in the first dimension (z-dimension) through the mass analyser or separator and/or second dimension (x-dimension) between the mirrors are controlled such that the ions are reflected a second number of times between the ion mirrors that is lower than said first number of times.

The third aspect may have any of the features described above in relation to the first and second aspects of the invention.

BRIEF DESCRIPTION OF THE DRAWINGS

Various embodiments will now be described, by way of example only, and with reference to the accompanying drawings in which.

DETAILED DESCRIPTION

Figure 1:
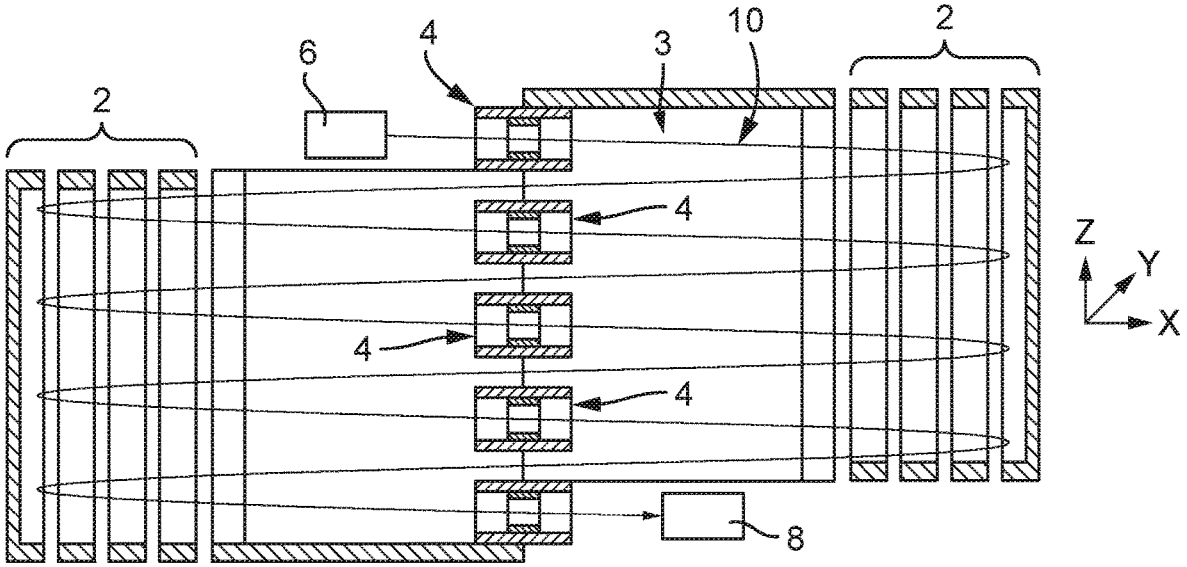
FIG. 1 shows a prior art MRTOF mass analyser.

FIG. 1 shows a known Multi-Reflecting TOF (MRTOF) mass spectrometer. The instrument comprises two ion mirrors 2 that are separated in the x-dimension by a field-free region 3. Each ion mirror 2 comprises multiple electrodes for reflecting ions in the x-dimension, and is elongated in the z-dimension. An array of periodic lenses 4 is arranged in the field-free region between the ion mirrors 2. An orthogonal ion accelerator 6 is arranged at one end of the analyser and an ion detector 8 is arranged at the other end of the analyser (in the z-dimension).

In use, an ion source delivers ions to the orthogonal ion accelerator 6, which accelerates packets of ions 10 into a first of the ion mirrors at an inclination angle to the x-axis. The ions therefore have a velocity in the x-dimension and also a drift velocity in the z-dimension. The ions enter into the first ion mirror and are reflected back towards the second of the ion mirrors. The ions then enter the second mirror and are reflected back to the first ion mirror. The first ion mirror then reflects the ions back to the second ion mirror. This continues and the ions are continually reflected between the two ion mirrors as they drift along the device in the z-dimension until the ions impact upon ion detector 8. The ions therefore follow a substantially sinusoidal mean trajectory within the x-z plane between the ion source and the ion detector 8.

However, the ions have a range of velocities in the z-dimension and hence tend to diverge in the z-dimension as they travel through the mass analyser. In order to reduce this divergence, the periodic lens array 4 is arranged such that the ion packets 10 pass through them as they are reflected between the ion mirrors 2. Voltages are applied to the electrodes of the periodic lens array 4 so as to spatially focus the ion packets in the z-dimension. This prevents the ion packets from diverging excessively in the z-dimension, which would otherwise result in some ions reaching the detector 8 having only been reflected a certain number of times and other ions reaching the detector having been reflected a larger number of times. The periodic lens array 4 therefore prevents ions have significantly different flight path lengths through the mass analyser on the way to the detector 8, which would reduce the resolution of the instrument. However, the lens array 4 may introduce TOF aberrations and the positions of the lens elements also limit the number of ion-mirror reflections that may be performed. The periodic lens also adds to the cost and complexity of the system.

The inventors of the present invention have recognised that another source of degradation of the spectral resolution in an MRTOF mass analyser is that different types of ions interact with background gas molecules to different degrees and are therefore angularly scattered by different amounts. This may lead to the different types of ions having different path lengths through the mass analyser and hence may cause spectral broadening of the mass peaks detected by the mass analyser. For example, ions having a relatively large molecular weight tend to have a relatively large collisional cross-section with the background gas molecules in the mass analyser and so are relatively likely to collide with residual gas molecules in the mass analyser. In contrast, ions having a relatively low molecular weight tend to have a relatively low collisional cross-section with the background gas molecules in the mass analyser and so are relatively less likely to collide with residual gas molecules in the mass analyser.

As described above, collisions between the ions and background gas molecules in the mass analyser lead to angular scattering and energy changes of the ions, resulting in spectral peak broadening. Several processes may be responsible for the degradation of TOF spectra. For example, elastic collisions that cause the ions to recoil and lose energy to the gas molecules may occur. Additionally, or alternatively, inelastic collisions may occur that cause the ions to lose neutral or charged particles (such as protons or solvent adducts) to the gas molecules. Additionally, or alternatively, inelastic collisions may occur that cause the ions to fragment via Collisionally Induced Dissociation (CID) into two or more fragment ions. Time of Flight aberrations may also occur during the collisional process due to the release of energy from the ions during dissociation, known as Derrick shift. The degradation of the TOF spectra may therefore be related to factors such as the collisional cross-sections of the ions, the length of the flight path of the ions, the energies of the ions and the susceptibility of the ions to fragment upon collisions with the background gas (for example, it has been observed that natively generated proteins that are compact and have low charge are less likely to fragment than denatured proteins).

The above described processes may change the number of ion-mirror reflections that ions experience and therefore cause considerable spectral noise. This may be particularly problematic for MRTOF mass analysers that do not include a periodic lens array between the ion mirrors for spatially focusing the ion packets in the z-dimension.

The above-mentioned problems may be mitigated by pumping the vacuum chamber of the mass analyser to extremely low pressures so that the concentration of background gas molecules is reduced. However, such pumping systems are expensive and such high vacuums are difficult to maintain in commercial mass spectrometers. Alternatively, the TOF detector may be operated in an energy discrimination mode, although this significantly reduces the ion signal detected.

The inventors have recognised that as different types of ions have different degrees of interaction with background gas molecules in the mass analyser, it may be desirable to cause the different types of ions to undergo different numbers of ion mirror reflections such that the different types of ions have different TOF path lengths through the mass analyser. In a first mode, ions having a relatively low degree of interaction with the background gas molecules may be caused to be reflected between the ion mirrors a relatively high number of times so that the TOF path length for these ions and their mass resolution is relatively high. For example, ions having a relatively low molecular weight may be reflected between the ion mirrors a relatively high number of times. In contrast, in a second mode, ions having a relatively high degree of interaction with the background gas molecules may be caused to be reflected between the ion mirrors a relatively low number of times so that the TOF path length for these ions is relatively low. For example, ions having a relatively high molecular weight may be reflected between the ion mirrors a relatively low number of times. Although the second mode may be expected to provide a lower mass resolution, the shorter path length means that these ions undergo a relatively low number of collisions with the background gas and hence will be scattered less. As the spectral quality and resolution becomes higher when less collisions occur, the second mode may provide a relatively high resolution even though it has a relatively short path length. This mode also helps to ensure that substantially all of the ions anaylsed in the second mode incur the same number of ion mirror reflections. The mass analyser may be configured so that the resolution in the second mode is maintained sufficiently high for the desired purpose, e.g. to define an isotope envelope of the analyte.

As described above, for high molecular weight ions it is advantageous to reduce the product of the gas pressure and path-length so as to avoid collisions with background gas molecules. However, permanently reducing the path-length is detrimental to the analysis of low molecular weight species, e.g. as TOF aberrations become more problematic for shorter ion flight times. The embodiments of operation described herein overcome these problems.

Figure 2A:
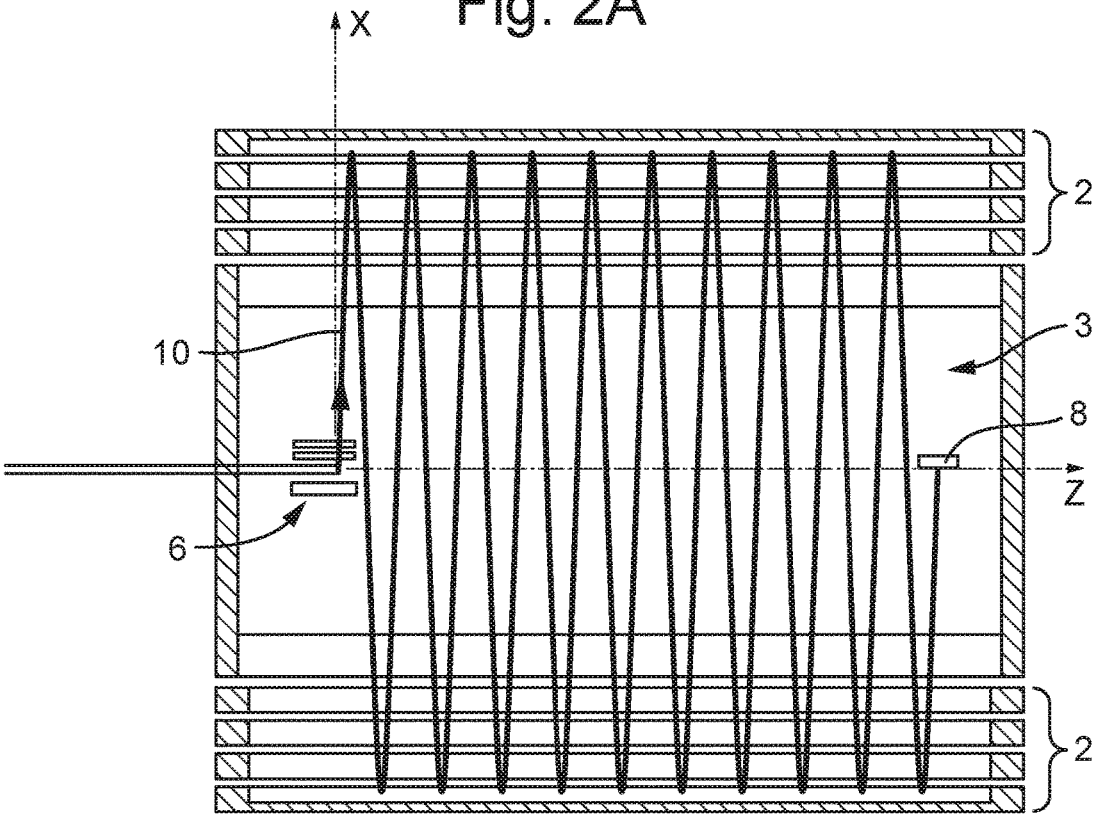
FIG. 2A shows a schematic of an MRTOF mass analyser according to an embodiment of the present invention whilst being operated in the first mode in which the ions enter mass analyser with a low drift velocity.

FIG. 2A shows a schematic of an MRTOF mass analyser according to an embodiment of the present invention whilst being operated in the first mode. The instrument comprises two ion mirrors 2 that are separated in the x-dimension by a field-free region 3. Each ion mirror 2 comprises multiple electrodes so that different voltages may be applied to the electrodes to cause the ions to be reflected in the x-dimension. The electrodes are elongated in the z-dimension, which allows the ions to be reflected multiple times by each mirror 2 as they pass through the device, as will be described in more detail below. Each ion mirror 2 may form a two-dimensional electrostatic field in the X-Y plane. The drift space 3 arranged between the ion mirrors 2 may be substantially electric field-free such that when the ions are reflected and travel in the space between the ion mirrors 2 they travel through a substantially field-free region 3. An orthogonal ion accelerator 6 is arranged at one end of the mass analyser and an ion detector 8 is arranged at the other end of the analyser (in the z-dimension).

In use, ions are received in the MRTOF mass analyser and pass into the orthogonal accelerator 6, e.g. along a first axis (e.g. extending in the z-dimension). This allows the duty cycle of the instrument to remain high. The orthogonal accelerator 6 pulses the ions (e.g. periodically) orthogonally to the first axis (i.e. pulsed in the x-dimension) such that packets of ions travel in the x-dimension towards and into a first of the ion mirrors 2. The ions retain a component of velocity in the z-dimension from that which they had when passing into the orthogonal accelerator 6. As such, ions are injected into the time of flight region 3 of the instrument at a relatively small angle of inclination to the x-dimension, with a major velocity component in the x-dimension towards the first ion mirror 2 and a minor velocity component in the z-dimension towards the detector 8.

The ions pass into a first of the ion mirrors and are reflected back towards the second of the ion mirrors. The ions pass through the field-free region 3 between the mirrors 2 as they travel towards the second ion mirror and they separate according to their mass to charge ratios in the known manner that occurs in field-free regions. The ions then enter the second mirror and are reflected back to the first ion mirror, again passing through the field-free region 3 between the mirrors as they travel towards the first ion mirror. The first ion mirror then reflects the ions back to the second ion mirror. This continues and the ions are continually reflected between the two ion mirrors 2 as they drift along the device in the z-dimension until the ions impact upon ion detector 8. The ions therefore follow a substantially sinusoidal mean trajectory within the x-z plane between the orthogonal accelerator 6 and the ion detector 8. The time that has elapsed between a given ion being pulsed from the orthogonal accelerator 6 to the time that the ion is detected may be determined and used, along with the knowledge of the flight path length, to calculate the mass to charge ratio of that ion.

In the first mode, the mass spectrometer is configured to cause the ions to be reflected a relatively high number of times between the ion mirrors as the ions pass from the orthogonal accelerator 6 to the detector 8, thus providing a relatively long ion flight path and high mass resolution. This may be achieved by causing ions to have a relatively low velocity in the z-dimension as they travel through the mass analyser. For example, ions may be caused to enter the mass analyser having a relatively low velocity in the z-dimension (e.g. having a kinetic energy in the z-dimension of 20 qV). Ions may be accelerated into the mass analyser by a potential difference and the potential difference may be selected so as to cause ions to have a relatively low velocity in the z-dimension as they travel through the mass analyser.

The mass analyser may be operated in the first mode for optimising the analysis of ions having a relatively low degree of interaction with background gas molecules in the mass analyser, e.g. relatively low molecular weight ions. A molecular weight filter or separator may be provided upstream of the mass analyser so as to (only) transmit relatively low molecular weight ions into the mass analyser when it is being operated in the first mode. Alternatively, the mass analyser may be operated in the first mode when it is known that the analyte ions are (only) relatively low molecular weight ions. The spectrometer may be configured such that in the first mode all ions received in the MRTOF mass analyser perform the same number of ion mirror reflections when pulsed from the orthogonal accelerator 6 to the detector 8. However, it is also contemplated that the mass analyser may be alternated between the first mode and the second mode (discussed in more detail below) during a single experimental run so as to optimise the analysis of both low and high molecular weight ions.

Although 20 ion mirror reflections are shown in FIG. 2, the spectrometer may be set so as to cause ions to undergo a different numbers of ion reflections.

Figure 2B:
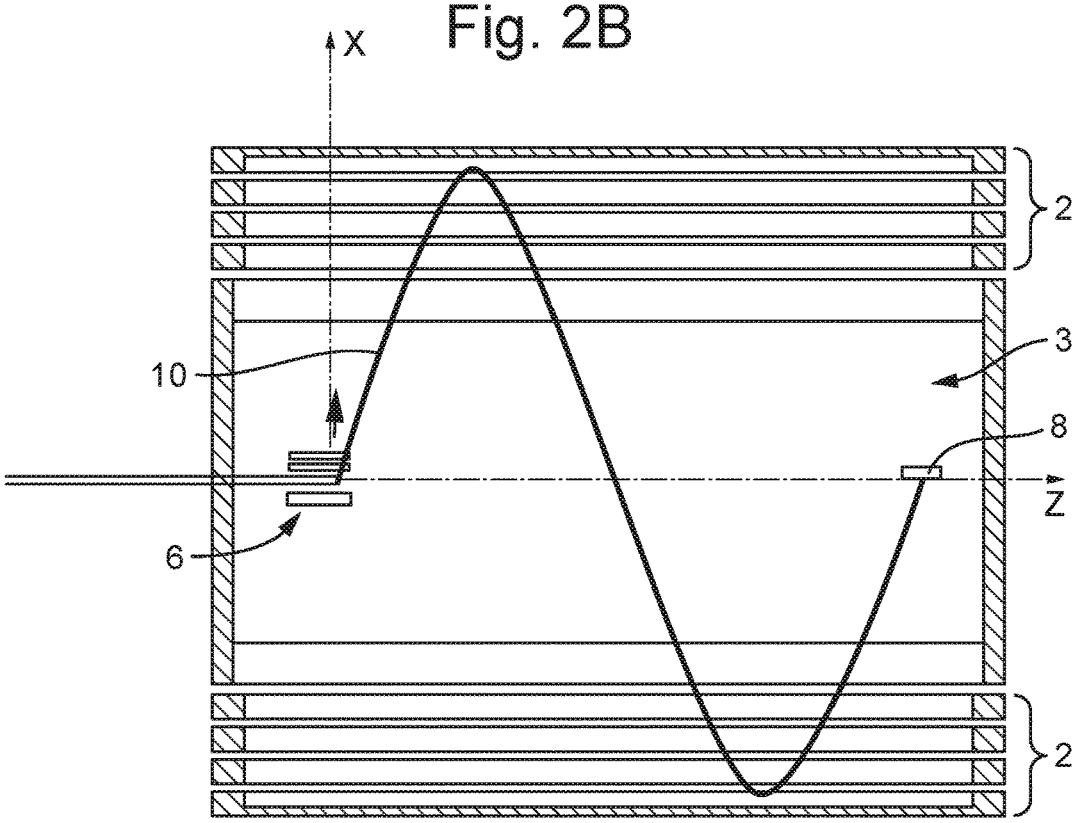
FIG. 2B shows the mass analyser whilst being operated in the second mode in which the ions enter mass analyser with a high drift velocity.

FIG. 2B shows the mass analyser of FIG. 2A whilst being operated in the second mode. This mode operates in the same way as the first mode described above in relation to FIG. 2A, except that the ions are caused to be reflected between the ion mirrors 2 fewer times than in the first mode. In the second mode, the mass spectrometer is therefore configured to cause the ions to be reflected a relatively low number of times between the ion mirrors 2 as the ions pass from the orthogonal accelerator 6 to the detector 8, thus providing a relatively short ion flight path. This may be achieved by causing ions to have a relatively high velocity in the z-dimension as they travel through the mass analyser. For example, ions may be caused to enter the mass analyser having a relatively high velocity in the z-dimension (e.g. having a kinetic energy in the z-dimension of 2000 qV). Ions may be accelerated into the mass analyser by a potential difference and the potential difference may be selected so as to cause ions to have a relatively high velocity in the z-dimension as they travel through the mass analyser.

The mass analyser may be operated in the second mode for optimising the analysis of ions having a relatively high degree of interaction with background gas molecules in the mass analyser, e.g. relatively high molecular weight ions.

It is contemplated that a molecular weight filter or separator may be provided upstream of the mass analyser so as to (only) transmit relatively high molecular weight ions into the mass analyser when it is being operated in the second mode. For example, an ion mobility separation (IMS) device may be arranged upstream of the mass analyser so as to deliver ions to the mass analyser in order of ion mobility. The mass analyser may be synchronised with the IMS device such that higher mobility ions eluting from the IMS device are analysed in the first mode and lower mobility ions eluting from the IMS device are analysed in the second mode.

Alternatively, the mass analyser may be operated in the first mode whilst it is known that the sample being analysed includes (only) analyte ions having relatively low molecular weight ions and operated in the second mode whilst it is known that the sample being analysed includes (only) analyte ions having relatively high molecular weight ions.

It is also contemplated that the mass analyser may be alternated between the first mode and the second mode during a single experimental run so as to optimise the analysis of both low and high molecular weight ions, e.g. that may be analysed simultaneously.

The spectrometer may be configured such that in the second mode all ions received in the MRTOF mass analyser perform the same number of ion mirror reflections when pulsed from the orthogonal accelerator 6 to the detector 8. Although only two ion mirror reflections are shown in FIG. 2, the spectrometer may be set so as to cause ions to undergo a different numbers of ion reflections.

Although embodiments have been described in which the kinetic energy (in the z-dimension) of the ions entering the mass analyser is altered so as to cause different numbers of ion mirror reflections in the first and second modes, it is contemplated that other techniques may be used for varying the number of ion-mirror reflections. For example, the ions may be caused to have different average speeds in the second dimension (x-dimension) between the ion mirrors 2 in the first and second modes. This may be achieved, for example, by varying one or more voltage applied to one or more of the ion mirrors 2 between the first and second modes and/or by varying one or more voltage applied to the orthogonal accelerator 6 between the first and second modes.

Figure 3:
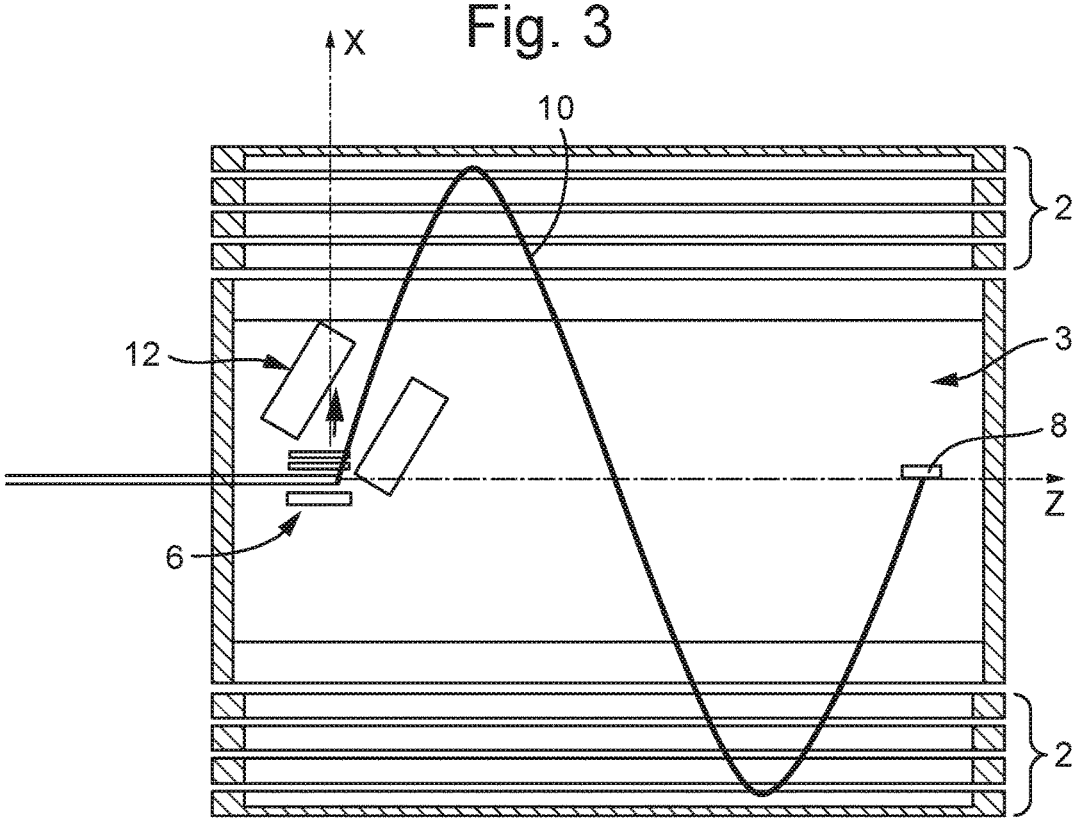
FIG. 3 shows a schematic of an MRTOF mass analyser according to another embodiment (whilst being operated in the second mode) in which the ion trajectory is deflected at different angles by a deflection module in the first and second modes.

FIG. 3 shows a schematic of an MRTOF mass analyser according to another embodiment of the present invention (whilst being operated in the second mode). This embodiment operates in the same way as the embodiment described above in relation to FIGS. 2A-2B, except that a deflection module 12 is arranged downstream of the orthogonal accelerator for controlling the velocity of the ions in the z-dimension within the mass analyser and hence the number of ion-mirror reflections that the ions undergo. The deflection module 12 may comprise one or more electrode, and a voltage supplied connected thereto, that are arranged and configured to control the trajectory of the ions leaving the orthogonal accelerator 6. In the depicted embodiment the deflection module 12 comprises two spaced apart electrodes between which the ions travel and the voltage supply applied a potential difference between these electrodes so as to control the trajectory of the ions.

The ions are orthogonally pulsed by the orthogonal accelerator 6 towards the ion mirror 2 and the ions pass into the deflection module 12. The voltages applied to the electrodes of the deflection module 12 are controlled such that in the first mode the mean trajectory of the ions leaving the deflection module 12 is at a relatively small acute angle to the x-dimension. As such, the ions have a relatively low velocity in the z-dimension as they drift through the mass analyser and undergo a relatively high number of ion-mirror reflections. In the second mode, the voltages applied to the electrodes of the deflection module 12 are controlled such that the mean trajectory of the ions leaving the deflection module 12 is at a relatively large acute angle to the x-dimension. As such, the ions have a relatively high velocity in the z-dimension as they drift through the mass analyser and undergo a relatively low number of ion-mirror reflections.

This embodiment enables ions to enter the MRTOF mass analyser having the same energy in the z-dimension during both the first and second modes (e.g. a low energy such as 20 qV). This may be with or without changing the angle of the pusher module to improve the TOF resolution. However, it is contemplated that the ion energy in the z-dimension may be altered between the first and second modes in conjunction with using a deflection module as discussed above.

Embodiments of the present invention relate to an MRTOF mass analyser having substantially no focusing of the ions, in the z-dimension, between the ion mirrors 2 (e.g. there is no periodic lens 4 for focussing the ions in the z-dimension). Rather, the expansion of each packet of ions 10 in the z-dimension as it travels from the orthogonal accelerator 6 to the detector 8 is limited by choosing the appropriate ion flight path length through the mass analyser (i.e. the number of reflections) in the first and second modes such that the ions do not perform enough collisions with the background gas to cause the same type of ion to have different path lengths through the mass analyser in any given one of the modes. In contrast, MRTOF mass spectrometers have conventionally sought to obtain a very high resolution and hence require a high number of reflections between the ion mirrors 2. Therefore, conventionally it has been considered necessary to provide z-dimensional focussing using an array of periodic lenses arranged between the ion mirrors 2 to prevent the width of the ion packet diverging.

In order to illustrate the advantages of the embodiments discussed herein, a numerical example is described below.

Mean free path calculations predict that the mean number of collisions, $N_c$, between an ion and gas molecules within a TOF mass analyser is given by:

$$Nc=k.A.P.L$$

where k is a constant (241), A is the collisional cross-section area of the ion in units of Angstrom squared, P is the pressure of the background gas in mbar, and L is the flight path length that the ion travels in the TOF mass analyser in metres (not the effective path length).

Therefore, for the example of a large molecular weight ion such as a monoclonal antibody having a collisional cross-section area of ~7000 $A^2$ and being analysed in an MRTOF mass analyser that is maintained at a pressure of $5\times10^{-8}$ mbar and that provides a flight path length of 20 m in the first mode, the mean number of collisions are greater than unity and approximately 1.7. The spectral quality of the MRTOF mass analyser under these conditions is relatively poor as the collisions cause the ions to be reflected by differing numbers of ion-mirror reflections, providing multiple path lengths and flight times for the same type of ion. However, switching to the second mode in which the flight path length is reduced by a factor of ten to just 2 m reduces the mean number of collisions to less than unity (approximately 0.17). This may be performed, for example, by increasing the kinetic energies (in the z-dimension) of the ions by a factor of 100 (e.g. from 20 qV to 2000 qV). The second mode reduces the ion-gas collisions, resulting in the ions undergoing a constant number of ion-mirror reflections and thus providing substantially the same path length and flight time for the same type of ion.

Although the present invention has been described with reference to preferred embodiments, it will be understood by those skilled in the art that various changes in form and detail may be made without departing from the scope of the invention as set forth in the accompanying claims.

For example, although embodiments have been described in which the mass analyser is alternated between two modes in which different numbers of ion mirror reflections are performed, it is contemplated that any number of modes may be conducted in which different numbers of ion mirror reflections are performed. It is contemplated that third, fourth or fifth (or further) modes may be performed in which three, four or five (or more) different numbers of ion-mirror reflections are performed, respectively. This may be particularly useful where the ions are separated upstream of the mass analyser, e.g. by an ion mobility separator (IMS) device. In these embodiments, the mass analyser may be synchronised with the ion separator such that the mass analyser is stepped between the different modes whilst the ions elute from the separator. For example, the mass analyser may switch modes as the ions elute such that the number of ion mirror reflections in sequential modes are progressively decreased. This may ensure the optimum number of ion mirror reflections and highest resolution possible for each type of ion eluting. Separate spectra may be acquired during each mode.

Although the embodiments have been described in which ions travel the same distance in the z-dimension of the MRTOF mass analyser in both the first and second modes, it is contemplated that the ions may be caused to travel a greater distance in the z-dimension in the first mode than in the second mode such that the ions perform a greater number of ion-mirror reflections in the first mode than the second mode. This may be achieved, for example, by providing two detectors at different locations in the z-dimension such that in the first mode the ions are detected at the detector that is arranged further away from the orthogonal accelerator in the z-dimension and in the second mode the ions are detected by the detector that is located closer to the orthogonal accelerator in the z-dimension. Alternatively, the ions may be reflected in the z-dimension in the first mode a greater number of times that the ions are reflected in the z-dimension (if at all) in the second mode such that the ions perform a greater number of ion-mirror reflections in the first mode than in the second mode before reaching a detector. In these embodiments, the pitch at which ions are reflected in the ion mirrors (i.e. the ion trajectory angles) may be the same or different in the first and second modes.

Although the embodiments have been described in relation to an MRTOF mass analyser having a detector for determining the mass to charge ratios of the ions, it is alternatively contemplated that the ion mirrors may simply provide a mass separation region without a TOF detector.

The invention claimed is:

1. A mass spectrometer comprising:

a multi-reflecting time of flight (MRTOF) mass analyser or mass separator having two gridless ion mirrors that are elongated in a first dimension (z-dimension) and configured to reflect ions multiple times in a second orthogonal dimension (x-dimension) as the ions travel in the first dimension;

a controller configured to operate the spectrometer in: (i) a first mode for mass analysing or mass separating ions having a first rate of interaction with background gas molecules in the mass analyser or separator, in which the velocities of ions in the first dimension (z-dimension) through the mass analyser or separator and/or second dimension (x-dimension) between the mirrors are controlled such that the ions are reflected a first number of times between the ion mirrors; and (ii) a second mode for mass analysing or mass separating ions having a second, higher rate of interaction with background gas molecules in the mass analyser or separator, in which the velocities of the ions in the first dimension (z-dimension) through the mass analyser or separator and/or second dimension (x-dimension) between the mirrors are controlled such that ions are reflected a second number of times between the ion mirrors that is lower than said first number of times; and an ion separator arranged upstream of the MRTOF mass analyser or mass separator, wherein the controller is configured to synchronise the ion separator with the MRTOF mass analyser or mass separator such that, in use, ions having the first rate of interaction with the background gas molecules are transmitted into the MRTOF mass analyser or mass separator whilst it is controlled to be in the first mode and ions having the second, higher rate of interaction with the background gas molecules are transmitted into the MRTOF mass analyser or mass separator when it is controlled to be in the second mode.

2. The spectrometer of claim 1, wherein the two ions mirrors are configured to reflect ions over substantially the same length in the first dimension (z-dimension).

3. The spectrometer of claim 1 wherein the mass analyser or mass separator comprises an ion accelerator for accelerating ions into one of the ion mirrors and that is arranged between the ion mirrors; and/or comprising an ion detector for detecting ions after having been reflected by the ion mirrors and that is arranged between the ion mirrors.

4. The spectrometer of claim 1, wherein the mass analyser or separator is configured to be maintained at a pressure of: 2: 1×10-8 mbar, 2: 2×10-8 mbar, 2: 3×10-8 mbar>4×10-8 mbar>5×10-8 mbar>, _, _, _6×10-8 mbar, _>7×10-8 mbar, _>8×10-8 mbar, _>9×10-8 mbar, _>1×10-7 mbar, _>5×10-7 mbar, _>1×10-6 mbar, _>5×10-6 mbar, _>1×10-5 mbar, _>5×10-5 mbar, _>1×10-4 mbar, _>5×10-4 mbar, _>1×10-3 mbar, _>5×10-3 mbar' or →1×10-2 mbar.

5. The spectrometer of claim 1, wherein said first number of times that the ions are reflected in the ion mirrors is greater than said second number of times by a factor of: 2:2, 2:3, 2:4, 2:5, 2:6, 2:7, 2:8, 2:9, 2:10, 2:11, 2:12, 2:13, 2:14, 2:15, 2:16, 2:17, 2:18, 2:19, or 2:20.

6. The spectrometer of claim 1, wherein the controller is configured such that substantially all of the ions analysed in the first mode undergo the same number of reflections in the ion mirrors and/or wherein substantially all of the ions analysed in the second mode undergo the same number of reflections in the ion mirrors.

7. The spectrometer of claim 1, wherein the controller is configured such that in the first mode the ions have velocities in the first dimension (zdimension) through the mass analyser or separator in a first range, and in the second mode the ions have velocities in the first dimension (z-dimension) through the mass analyser or separator in a second, lower range; and/or wherein the controller is configured such that in the first mode the ions have speeds in the second dimension (x-dimension) between the ion mirrors in a first range, and in the second mode the ions have speeds in the second dimension (x-dimension) between the ions mirrors in a second, lower range.

8. The spectrometer of claim 7, comprising electrodes and one or more voltage supply configured to apply a potential difference between the electrodes that accelerates or decelerates the ions such that in the first mode ions enter the MRTOF mass analyser or mass separator with said velocities in the first dimension (z-dimension) such that the ions are reflected said first number of times, and in the second mode ions enter the MRTOF mass analyser or mass separator with said velocities in the first dimension (z-dimension) such that the ions are reflected said second number of times.

9. The spectrometer of claim 1, comprising a deflection module within the MRTOF mass analyser or separator that is configured to deflect the average trajectory of the ions in the first and/or second mode such that in the first mode the ions have velocities in the first dimension (z-dimension) through the mass analyser or separator in a first range; and in the second mode the ions have velocities in the first dimension (z-dimension) through the mass analyser or separator in a second higher range.

10. The spectrometer of claim 9, wherein the deflection module comprises one or more electrode, and a voltage supply connected thereto; and wherein the deflection module is configured to apply one or more voltage to the one or more electrode such that in the first mode the mean trajectory of the ions leaving the deflection module is at a relatively small acute angle to the second dimension (x-dimension) and in the second mode is at a relatively large acute angle to the second dimension (x-dimension).

11. The spectrometer of claim 9, comprising an orthogonal accelerator configured to receive ions along an ion receiving axis and accelerate those ions orthogonally to the ion receiving axis and towards one of the ion mirrors, and wherein the deflection module is arranged downstream of the orthogonal accelerator.

12. The spectrometer of claim 1, wherein the mass analyser or separator is configured such that ions are substantially not spatially focussed and/or collimated in the first dimension (z-dimension) as the ions travel between the ion mirrors; or wherein the mass analyser or separator is configured such that there are substantially no aberrations due to spatial focusing in the first dimension (z-dimension) as the ions travel between the ion mirrors.

13. A mass spectrometer comprising:

a multi-reflecting time of flight (MRTOF) mass analyser or mass separator having two gridless ion mirrors that are elongated in a first dimension (z-dimension) and configured to reflect ions multiple times in a second orthogonal dimension (x-dimension) as the ions travel in the first dimension;

a controller configured to operate the spectrometer in: (i) a first mode for mass analysing or mass separating ions having a first rate of interaction with background gas molecules in the mass analyser or separator, in which the velocities of ions in the first dimension (z-dimension) through the mass analyser or separator and/or second dimension (x-dimension) between the mirrors are controlled such that the ions are reflected a first number of times between the ion mirrors; and (ii) a second mode for mass analysing or mass separating ions having a second, higher rate of interaction with background gas molecules in the mass analyser or separator, in which the velocities of the ions in the first dimension (z-dimension) through the mass analyser or separator and/or second dimension (x-dimension) between the mirrors are controlled such that ions are reflected a second number of times between the ion mirrors that is lower than said first number of times; and a molecular weight filter arranged upstream of the MRTOF mass analyser or MRTOF mass separator, wherein the controller is configured to synchronise the molecular weight filter with the MRTOF mass analyser or mass separator such that, in use, ions having the first rate of interaction with the background gas molecules are transmitted into the MRTOF mass analyser or mass separator whilst it is controlled to be in the first mode and ions having the second, higher rate of interaction with the background gas molecules are transmitted into the MRTOF mass analyser or mass separator when it is controlled to be in the second mode.

14. A method comprising:

providing a mass spectrometer, comprising a multi-reflecting time of flight (MRTOF) mass analyser or mass separator having two gridless ion mirrors that are elongated in a first dimension (z-dimension) and configured to reflect ions multiple times in a second orthogonal dimension (x-dimension) as the ions travel in the first dimension;

operating the mass spectrometer, in a first mode to mass analyze or separate ions having a first rate of interaction with background gas molecules in the MRTOF mass analyzer or separator, wherein in the first mode the velocities of the ions in the first dimension (z-dimension) through the MRTOF mass analyser or separator and/or second dimension (x-dimension) between the mirrors are controlled such that the ions having the first rate of interaction with background gas molecules in the MRTOF mass analyser or mass separator are reflected a first number of times between the ion mirrors; and operating the or mass spectrometer, in a second mode to mass analyze or separate ions having a second, higher rate of interaction with background gas molecules in the MRTOF mass analyzer or mass separator, wherein in the second mode the velocities of the ions in the first dimension (z-dimension) through the MRTOF mass analyser or mass separator and/or second dimension (x-dimension) between the mirrors are controlled such that the ions having the second, higher rate of interaction with background gas molecules in the MRTOF mass analyser or mass separator are reflected a second number of times between the ion mirrors that is lower than said first number of times.

15. The method of claim 14, wherein the first ions have a lower molecular weight than the second ions.

16. The method of claim 14, wherein the first ions have a lower collisional cross-section with the background gas molecules than the second ions.

17. The method of claim 14 comprising providing ions to the mass analyser or mass separator that are separated by a physico-chemical property that determines the rate of interaction of the ions with the background gas molecules; operating in said first mode whilst ions having a first range of values of said physico-chemical property are transmitted into the MRTOF mass analyser or mass separator; and operating in said second mode whilst ions having a second range of values of said physico-chemical property are transmitted into the MRTOF mass analyser or mass separator.

18. The method of claim 14, wherein ions are substantially not spatially focussed and/or collimated in the first dimension (z-dimension) as the ions travel between the ion mirrors.

19. The method of claim 14, comprising operating the spectrometer in the first mode and in the second mode during a single experimental run.

* * * * *